US007999164B2

(12) United States Patent
Satomi

(10) Patent No.: US 7,999,164 B2
(45) Date of Patent: Aug. 16, 2011

(54) VALVE MECHANISM FOR MUSICAL INSTRUMENT AND BRASS INSTRUMENT PROVIDED WITH VALVE MECHANISM FOR MUSICAL INSTRUMENT

(76) Inventor: Shiro Satomi, Tokyo (JP)

( * ) Notice: Subject to any disclaimer, the term of this patent is extended or adjusted under 35 U.S.C. 154(b) by 181 days.

(21) Appl. No.: 12/513,996

(22) PCT Filed: Nov. 8, 2007

(86) PCT No.: PCT/JP2007/071742

§ 371 (c)(1),
(2), (4) Date: May 7, 2009

(87) PCT Pub. No.: WO2008/056752

PCT Pub. Date: May 15, 2008

(65) Prior Publication Data

US 2010/0275758 A1 Nov. 4, 2010

(30) Foreign Application Priority Data

Nov. 8, 2006 (JP) ..... 2006-302759

(51) Int. Cl.
*G10D 3/00* (2006.01)

(52) U.S. Cl. ..... 84/380 R

(58) Field of Classification Search ..... 84/380 R, 84/387 A, 388–394

See application file for complete search history.

(56) References Cited

U.S. PATENT DOCUMENTS

| | | | | |
|---|---|---|---|---|
| 2,794,358 | A * | 6/1957 | Albert | 84/388 |
| 4,127,050 | A | 11/1978 | Takeuchi et al. | |
| 5,052,261 | A | 10/1991 | Lessen | |
| 6,008,444 | A | 12/1999 | Chesko et al. | |

FOREIGN PATENT DOCUMENTS

| | | |
|---|---|---|
| JP | 51-153321 | 7/1978 |
| JP | 53-78825 A | 7/1978 |
| JP | 53-78826 A | 7/1978 |
| JP | 55-164686 | 11/1980 |
| JP | 55-053049 | 2/1981 |
| JP | 56-16196 A | 2/1981 |
| WO | WO-2008/056752 A1 | 5/2008 |

* cited by examiner

*Primary Examiner* — Kimberly R Lockett
(74) *Attorney, Agent, or Firm* — Bruzga & Associates; Charles E. Bruzga; Jay S. Pattumudi

(57) ABSTRACT

A valve mechanism for musical instrument is inserted between a mouthpiece and a bell. The valve mechanism includes: a main tube through which the mouthpiece and the bell directly communicate with each other; a bypass tube which takes a bypass route from the middle of the main tube and, when the changeover valve is operated, causes indirect communication of the main tube which is in direct communication before the operation of the changeover valve; a group of main valves; and a group of sub valves. Setting of the bypass tube to a length that allows for a note one octave lower than a note produced only by the main tube, which is producible when the main tube indirectly communicates via the bypass tube. As a result, a degree of freedom and reliability of musical performance are improved in a wide register with almost no change in weight, among many advantages.

12 Claims, 15 Drawing Sheets

VALVE MECHANISM FOR MUSICAL INSTRUMENT AND BRASS INSTRUMENT PROVIDED WITH VALVE MECHANISM FOR MUSICAL INSTRUMENT

TECHNICAL FIELD

The present invention relates to a valve mechanism for musical instrument capable of easily adjusting the scale in a wide register and a brass instrument provided with the valve mechanism for musical instrument.

BACKGROUND ART

In brass instruments, a valve mechanism (valve device) for scale adjustment is in practical use as an input/output part of a resonance tube because of its advantage of being capable of instantaneously bringing the resonance tube necessary for scale adjustment into communication via a piston hole irrespective of the length of the musical instrument and the order of a harmonic. Here "harmonics" refer to notes produced with the same fingering by controlling an aperture (size of an air column), a resistant feeling (pressure) of breath, and a change in tension (support) of muscles of sounding organ parts, which are factors controlling the pitch of a note in a brass instrument such as a trumpet. In other words, if "sol (G)" note is produced when the musical instrument is blown normally, the same "sol (G)" note which is one octave higher or two or more octave higher can be produced when the musical instrument is blown harder with the same fingering, and this high-pitch note is called a "harmonic". For example, as in a three valve system (having three valves in serial communication) in which one resonance tube is coupled to a sidewall of each columnar hollow portion called a valve casing, an ordinary valve mechanism for brass instrument adjusts an overall length of tubing by combining a relatively small number of resonance tubes and valves, thereby changing the pitches of notes for scale adjustment. In this system, the operation of the first valve (in a trumpet, a valve closest to a mouthpiece) brings one resonance tube corresponding to a whole step (one tone) into communication, the operation of the second valve brings one resonance tube corresponding to a half step into communication, and the operation of the third valve brings one resonance tube corresponding to a whole and a half steps (one and a half tones) into communication. The communication of the resonance tubes results in an increase in the overall length of the tubing by the lengths of the resonance tubes due to the detouring of the tubing, thereby lowering the pitch of the notes. Therefore, by combining the aforesaid one step, a half step, and 1.5 steps, it is possible to produce notes that could not be produced without any valve. For example, in a trumpet without any valve, sol (G) would follow do (C) in a fundamental tone sequence (a fundamental tone sequence that is not a harmonic sequence), and none of re (D), mi (E), and fa (F) could be produced, and what makes it possible to produce these notes that could not be produced is the operation of the aforesaid combination of the valves. On the other hand, even with the valves, it is not always possible to produce correct notes by the valve operation. The lengths corresponding to the aforesaid one step, a half step, and 1.5 steps are determined by ratios to the overall length, and therefore, for example, the length corresponding to one step when the pitch is lowered by one step by the operation of only the first valve and the length corresponding to one step when the pitch is lowered by 1.5 steps (semitone+one tone) by the simultaneous operation of the second valve and the first valve are different from each other. That is, when seen from the first valve, the overall length is longer by a detour length due to the simultaneous operation of the second valve, compared with that when only the first valve is operated, and thus a length ratio for one step changes. This is a reason why the correct pitch note cannot be produced only with the valves. A difference in pitch caused by such a difference in the overall length is corrected by using tuning slides and lips of a player.

As for pitch correction by the simultaneous operation of a plurality of valves (for example, the simultaneous operation of the aforesaid first valve and second valve), an allowance is given by designing resonance tubes a little short in consideration of relative easiness of the downward pitch correction by the lips while the musical instrument is played and a difference between equal temperament and just temperament, and since only relatively small pitch correction is necessary when the second valve and the third valve are simultaneously operated, it has been practically sufficient if the resonance tube of the third valve is set to an appropriate length and only the downward pitch correction is made by the lips while the musical instrument is played.

However, in a high register where relatively high-order harmonics are produced, due to a narrow interval between two adjacent harmonics, reliability in sounding is lowered, and it is not easy either to make the downward pitch correction by the lips while the musical instrument is played. Therefore, for every register where a sufficiently large interval between harmonics can be ensured, it has been necessary to use a different musical instrument whose overall length is relatively short, thereby obtaining reliability in sounding in a high register. As described above, there has been a drawback that it is only in one of a high register and a low register that one kind of a musical instrument can obtain a degree of freedom in scale adjustment by using a relatively low-order harmonic range where an interval between harmonics is wide.

In the application where arbitrary musical compositions of music in general are played, this drawback is a great obstacle to a degree of freedom of musical performance. Concretely, there have been problems that part of notes is lacking during complicated scale adjustment in a register where an interval between harmonics is relatively narrow, an unnecessary note is produced during the scale adjustment of a high register, a note necessary for playing a musical composition cannot be produced due to the lack of a note in a low register, and the like.

One of methods to solve the problems is to use a four valve system and expand the lowest register further downward by 2.5 steps by coupling a bypass tube by a fourth valve. FIG. 20 is a tubing view showing a coupling route of a valve device and resonance tubes by this method. In FIG. 20, 23 denotes a first valve, 24 a second valve, 25 a third valve, 26 a fourth valve, 3 a mouthpiece, 5 a bell, 23*v*, 24*v*, and 25*v* resonance tubes, 7 a main tube, and 9 a bypass tube. However, nor is this method capable of improving reliability in the scale adjustment in a relatively high-order harmonic range because an interval between harmonics of the main tube which is a musical instrument main body is not changed, and great pitch correction is required also when the plural valves are simultaneously operated in the lowest register. A method in which bypass tubing of a fourth valve which lowers the register by 2.5 steps is made to communicate with correction tubes of a first, a second, and a third valve to automatically adjust the overall length of resonance tubes coupled to the first, second, and third valves according to the overall length of the bypass tubing as in an euphonium and a semidouble horn (FIG. 21) including an automatic pitch correction mechanism (correction pitch system) called a compensating system (see a patent document 1) requires that each of the correction tubes has a length substantially equal to a gap between a pair of coupled openings of the resonance tube, and thus this method is not applicable to a musical instrument whose resonance tubes are short and whose correction tubes accordingly become extremely short, such as a piccolo trumpet. Further, since the operation of the fourth valve results in a change in fundamental tonality unique to the musical instrument such as a C instrument and a B-flat instrument, fingering transposition is necessary. FIG. 21 is a tubing view by this method, and among the reference symbols shown in FIG. 20, the same reference symbols as those in FIGS. 1 and 2 represent the same members. Further, 33*v*, 34*v*, and 35*v* are the correction tubes. The automatic pitch correction mechanism proposed in the patent document 1 is a method for realizing such correction tubes with extremely short length, but since, in this method, the pitch correction when the first or second valve and the third or fourth valve are simultaneously operated is realized only in the alternative combinations, it is necessary that separate bypass tubes are provided and the bypass tubes communicate with the first or second valve in order for the third and fourth valves to have a pitch correction mechanism. Another method is to use a first, a second, and a third valve to each of which one set or two sets of resonance tubes different in length are independently coupled and switch to a bypass tube with different tonality by a fourth valve or the like, as in a full double horn and a full triple horn, but this further increases the weight of the musical instrument and also complicates fingering. FIG. 22 is a tubing view by this method, and among the reference symbols shown in FIG. 20, the same reference symbols as those in FIGS. 1 and 2 represent the same members. Further, 33*v*, 34*v*, and 35*v* denote resonance tubes. FIG. 23 is a tubing view of a piccolo trumpet according to an embodiment of the present invention which will be described later. The same reference symbols as those in FIGS. 1 and 2 are used in FIG. 23. This is attached for comparison. Patent document 1: U.S. Pat. No. 5,052,261

DISCLOSURE OF THE INVENTION

Problems to be Solved by the Invention

The present invention was made to solve the aforesaid problems and has an object to provide a valve mechanism for musical instrument allowing the use of relatively low-order harmonics even in a high register and is capable of improving a degree of freedom and reliability of scale adjustment over a wide register without using bypass tubes different in tonality, any special fingering, or any correction tube, and to provide a brass instrument provided with the valve mechanism for musical instrument. Details thereof will be described in different paragraphs. It should be noted that the definition of terms and so on used in the description of the invention of any one of the claims are applied also to the inventions of the other claims within a permissible range irrespective of the order of the description of the claims.

Means for Solving the Problems

Feature of Invention of Claim 1

A valve mechanism for musical instrument according to an invention of claim 1 (hereinafter, referred to as a valve mechanism of claim 1" when appropriate) is a valve mechanism for musical instrument inserted between a mouthpiece and a bell. The valve mechanism of claim 1 includes: a main tube through which the mouthpiece and the bell directly communicate with each other; a changeover valve inserted in the middle of the main tube; a bypass tube which takes a bypass route from the middle of the main tube and, when the changeover valve is operated, causes indirect communication of the main tube which is in direct communication before the operation of the changeover valve; a main valve group composed of main valves inserted in serial communication in the middle of the main tube on a mouthpiece side or a bell side of the changeover valve; a sub valve group composed of the same number of sub valves as the number of the main valves of the main valve group, inserted in serial communication in the middle of the bypass tube; and a link mechanism group composed of the same number of link mechanisms as the number of the main valves of the main valve group. Here, the main valves composing the main valve group, the sub valves composing the sub valve group, and the link mechanisms composing the link mechanism group correspond to one another, and by operating each of the main valves, the corresponding sub valve is operable in linkage via the corresponding link mechanism, and the bypass tube is set to such a length that a note one octave lower than a note produced only by the main tube is producible when the main tube is brought into the indirect communication. It should be noted that the link mechanisms linking the main valves and the sub valves respectively are defined as the link mechanism group also when the corresponding main valves and sub valves are integrally formed.

According to the valve mechanism of claim 1, it is inserted between the mouthpiece and the bell and when operated, it is capable of adjusting the scale of the musical instrument. The main valve group, when the changeover valve is not operated, directly communicates only with the main tube, and is capable of adjusting the scale produced only by the main tube when operated. Here, when the changeover valve is operated, the overall length of the main tube is increased by the length of the bypass tube due to the indirect communication. Since the length of the bypass tube is set as described above, the operation of the changeover valve enables to produce a one octave lower note. When the main valves are operated in the indirect communication state, this operation causes the sub valves to be operated in linkage via the link mechanisms. That is, by operating the main valves, it is also possible to operate the corresponding sub valves. A note produced with fingering (fingerwork) in the direct communication state becomes a one octave lower note with the same fingering in the indirect communication state. A note produced without any operation of the changeover valve, for example, do (C) becomes one octave lower do (C) with the same fingering when the changeover valve is operated. It goes without saying that harmonics can be produced by hard blowing, irrespective of the operation of the changeover valve. According to the valve mechanism of claim 1, in melodies of a musical composition played by using a musical instrument provided with the valve mechanism, only by changing the changeover valve, it is possible to use relatively low-order harmonics even in a high register with the tonality left as it is (without changing fundamental tonality of the musical instrument such as a C instrument and a B-flat instrument), while making scale adjustment by selecting an ideal tube length. Therefore, there is an advantage of enabling remarkable improvement in a degree of freedom and reliability of musical performance in a wide register with almost no change in fingering and weight of a conventional brass instrument. This advantage is distinguished in a musical instrument producing relatively high-pitch notes (for example, a piccolo trumpet). The reason is that because of their characteristics, a piccolo trumpet and a trumpet have difficulty in producing the lowest fundamental (first harmonic), compared with a euphonium and a horn, and a range of a low register that it can obtain by the aforesaid compensating system is limited to notes higher than the first harmonic.

Feature of Invention of Claim 2

A valve mechanism for musical instrument according to an invention of claim 2 (hereinafter, referred to as a valve mechanism of claim 2" when appropriate) is a valve mechanism for musical instrument inserted between a mouthpiece and a bell. The valve mechanism of claim 2 includes: a main tube through which the mouthpiece and the bell directly communicate with each other; a changeover valve inserted in the middle of the main tube; a bypass tube which takes a bypass route from the middle of the main tube and when the changeover valve is operated, causes indirect communication of the main tube which is in direct communication before the operation of the changeover valve; a main valve group composed of main valves inserted in serial communication in the middle of the main tube on a mouthpiece side or a bell side of the changeover valve; a sub valve group composed of the same number of sub valves as the number of the main valves of the main valve group, inserted in serial communication in the middle of the bypass tube; and a link mechanism group composed of the same number of link mechanisms as the number of the main valves of the main valve group. Here, the main valves composing the main valve group, the sub valves composing the sub valve group, and the link mechanisms composing the link mechanism group correspond to one another, and by operating each of the main valves, the corresponding sub valve is operable in linkage via the corresponding link mechanism, and the bypass tube is set to such a length that an acoustic length becomes about 2L due to the indirect communication via the bypass tube, is where L is an acoustic length of the main tube.

According to the valve mechanism of claim 2, it is inserted between the mouthpiece and the bell and when operated, it is capable of adjusting the pitch of the musical instrument. The main valve group, when the changeover valve is not operated, directly communicates only with the main tube, and is capable of adjusting the pitch produced only by the main tube when operated. Here, when the changeover valve is operated, the overall length of the main tube is increased by the length of the bypass tube due to the indirect communication. Since the length of the bypass tube is set as described above, the operation of the changeover valve enables to produce a one octave lower note. When the main valves are operated in the indirect communication state, this operation causes the sub valves to be operated in linkage via the link mechanisms. That is, by operating the main valves, it is also possible to operate the corresponding sub valves. A note produced with fingering (fingerwork) in the direct communication state becomes a one octave lower note with the same fingering in the indirect communication state (in the state where the acoustic length which was L becomes about 2L (becomes substantially doubled)). A note produced without any operation of the changeover valve, for example, do (C) becomes one octave lower do (C) with the same fingering when the changeover valve is operated. It goes without saying that harmonics can be produced by hard blowing, irrespective of the operation of the changeover valve. According to the valve mechanism of claim 2, in melodies of a musical composition played by using a musical instrument provided with the valve mechanism, only by changing the changeover valve, it is possible to use relatively low-order harmonics even in a high register with the tonality left as it is (without changing fundamental tonality of the musical instrument such as a C instrument and a B-flat instrument), while making scale adjustment by selecting an ideal tube length. Therefore, there is an advantage of enabling remarkable improvement in a degree of freedom and reliability of musical performance in a wide register with almost no change in fingering and weight of a conventional brass instrument. This advantage is distinguished in a musical instrument producing relatively high-pitch notes (for example, a piccolo trumpet). The reason is that because of their characteristics, a piccolo trumpet and a trumpet have difficulty in producing the lowest fundamental (first harmonic), compared with a euphonium and a horn, and a range of a low register that it can obtain by the aforesaid compensating system is limited to notes higher than the first harmonic.

Feature of Invention of Claim 3

A valve mechanism for musical instrument according to an invention of claim 3 (hereinafter, referred to as "a valve mechanism of claim 3" when appropriate) includes the basic structure of the valve mechanism of claim 1 or claim 2, and in addition, the main valves and the sub valves have substantially the same structure.

According to the valve mechanism of claim 3, it is possible to produce a one octave lower note with a simple structure. Specifically, in order to produce a one octave lower note by the changeover of the changeover valve, it is necessary to acoustically double the length of the main tube, and by the corresponding main valves and sub valves having substantially the same acoustic structure, it is possible to satisfy this requirement without adopting a complicated structure.

Feature of Invention of Claim 4

A valve mechanism for musical instrument according to an invention of claim 4 (hereinafter, referred to as "a valve mechanism of claim 4" when appropriate) includes the basic structure of the valve mechanism of claim 3, and in addition: the main valves include main valve casings each having a columnar hollow portion surrounded by a sidewall, main pistons provided with piston holes and sealed inside the respective main valve casings to be slidable in a longitudinal direction, and main U-shaped resonance tubes with different lengths which are provided outside the main valve casings and whose both ends communicate with the columnar hollow portions; the sub valves include sub valve casings each having a columnar hollow portion surrounded by a sidewall, sub pistons provided with piston holes and sealed inside the sub valve casings to be slidable in the longitudinal direction, and sub U-shaped resonance tubes with different lengths which are provided outside the sub valve casings and whose both ends communicate with the columnar hollow portions, and the valve mechanism further comprises biasing members (for example, coil springs) disposed inside the main valve casings and/or the sub valve casings, and acoustic lengths of the sub U-shaped resonance tubes are set substantially equal to acoustic lengths of the corresponding main U-shaped resonance tubes. The biasing members are disposed inside one of or both of the main valve casings and the sub valve casings.

According to the valve mechanism of claim 4, it is possible to effectively exhibit the operation and effect of the valve mechanism of claim 3. To operate the valves, the main pistons and the sub pistons are moved in the longitudinal direction in the main valve casings and the sub valve casings while resisting biasing forces of the biasing members. The movement causes the communication of the main U-shaped resonance tubes and the sub U-shaped resonance tubes which are closed before the movement. As a result of the above communication, the main tube which is in direct communication before the above communication is brought into communication (indirect communication) via the main U-shaped resonance tubes and the sub U-shaped resonance tubes (via a bypass route), whereby pitch adjustment is made for each valve relevant to the operation. When the valve operation is cancelled, the biasing member relevant to the cancellation returns the main piston and the sub piston to the original positions, whereby the communication of the main U-shaped resonance tube and sub U-shaped resonance tube relevant to the returning are intercepted. Since the acoustic lengths of the main U-shaped resonance tubes and the corresponding sub U-shaped resonance tubes are set substantially equal to each other, the linked operation of the main valves and the corresponding sub valves lowers the pitch by acoustically substantially the same degree both in the main tube and in the bypass tube. As a result, by the changeover of the changeover valve, the total length of the main tube, the main U-shaped resonance tubes, the bypass tube, and the sub U-shaped resonance tubes becomes acoustically substantially doubled, compared with the length of only the single main tube, which makes it possible to surely produce a note at a one octave lower pitch than the pitch produced only by the main tube, owing to the co-use of the bypass tube.

Feature of Invention of Claim 5

A valve mechanism for musical instrument according to an invention of claim 5 (hereinafter, referred to as "a valve mechanism of claim 5" when appropriate) includes the basic structure of the valve mechanism according to claim 1 or 2, and in addition, at least one of the main U-shaped resonance tubes and at least one of the sub U-shaped resonance tubes are tuning slides.

According to the valve mechanism of claim 5, besides the operation and effect of the valve mechanism of claim 1 or 2, the main U-shaped resonance tube and the sub U-shaped resonance tube formed by the tuning slides are capable of fine adjustment of the pitch when their insertion degree is adjusted to finely adjust the lengths of the main U-shaped resonance tube and the corresponding sub U-shaped resonance tube. Since the fine adjustment is possible, musical performance with more reliable tonality (other notes are well-organized and have subordinate relation with respect to the fundamental note) is enabled.

Feature of Invention of Claim 6

A valve mechanism for musical instrument according to an invention of claim 6 (hereinafter, referred to as "a valve mechanism of claim 6") includes the basic structure of the valve mechanism of claim 1 or 2, and in addition, the main valves and the sub valves are rotary valves.

According to the valve mechanism of claim 6, the rotary valves can provide the operation and effect of the valve mechanism of claim 1 or 2. The rotary valves of a type having rotors rotating in a circumferential direction inside the columnar hollow portions are inserted both in the main tube and the bypass tube, which can provide the above operation and effect in a good condition. This does not intend to exclude valves other than the rotary valves (for example, the aforesaid piston valves), and provided that the valves are capable of attaining the object of the present invention, the type thereof does not matter, but it is generally said that the use of the rotary valves can produce soft sound sympathizing with string instruments and other wind instruments. This is contrastive to a piston valve that is said to be capable of producing sound that is brilliant and distinguished so as to be heard from above the other instruments. The rotary valves, piston valves, further other valves may be selected according to the preference.

Feature of Invention of Claim 7

A brass instrument according to an invention of claim 7 (hereinafter, referred to as "a brass instrument of claim 7" when appropriate) has the valve mechanism of any one of claims 1 to 6. A trumpet and a horn are typical examples of the brass instrument.

According to the brass instrument of claim 7, it is possible to enable musical performance exhibiting the operation and effect of the valve mechanism of any one of claims 1 to 6, that is, to produce a one octave lower note by the operation of the changeover valve.

Feature of Invention of Claim 8

In a brass instrument according to an invention of claim 8 (hereinafter, referred to as "a brass instrument of claim 8" when appropriate), a trumpet is the brass instrument on the premise of the brass instrument of claim 7.

According to the brass instrument of claim 8, the operation and effect of the valve mechanism of any one of claims 1 to 6 can be realized in the trumpet. This does not intend to limit the brass instrument to the trumpet, but since trumpets adopting piston valves or rotary valves are in wide use, the application of the present invention to such trumpets contributes to more widespread use.

Feature of Invention of Claim 9

A valve mechanism for musical instrument according to an invention of claim 9 (hereinafter, referred to as "a valve mechanism of claim 9" when appropriate) is a valve mechanism attachable/detachable to/from a brass instrument (its typical examples include a piccolo trumpet) including: first to fourth piston valves provided with bottom screws and inserted in order from a mouthpiece side toward a bell side; and a sliding resonance tube included in the fourth piston valve. The valve mechanism of claim 9 includes: a bypass tube having one end and the other end; first to third sub piston valves inserted in serial communication in the middle of the bypass tube; and three link mechanisms disposed inside the first to third sub piston valves respectively. The one end and the other end of the bypass tube are fixedly insertable to the fourth piston valve in place of the detached sliding resonance tube, and the first to third sub piston valves are screw-fixable to the first to third piston valves in place of the detached bottom screws. The three link mechanisms couple piston upper ends of the first to third sub piston valves and piston lower ends of the first to third piston valves and biasing members are disposed inside the main valve casings and/or the sub valve casings to allow the first to third sub piston valves to be operated in linkage by the operation of the first to third piston valves. Here, the bypass tube is set to such a length that a note one octave lower than a note produced only by the main tube is producible when the fourth piston valve is operated to open a bypass route from the middle of the main tube and bring the main tube, which is in direct communication before the operation of the fourth piston valve, into indirect communication.

According to the valve mechanism of claim 9, when it is attached to an existing brass instrument such as, for example, a piccolo trumpet, the brass instrument is capable of producing a one octave lower note. Here, a description will be given, taking a piccolo trumpet as an example. The piccolo trumpet includes the first to fourth piston valves, and the first to third piston valves include resonance tubes or tuning slides for lowering the pitch by one step, a half step, and 1.5 steps when necessary, and the fourth piston valve includes the tuning slide for lowering the pitch by 2.5 steps. Further, the piston valves include the bottom screws at bottom portions thereof. The bottom screws of the first to third piston valves are detached, and instead, the first to third sub piston valves are screw-fixed. The bottom screw of the fourth piston valve need not to be detached. Prior to the fixation, the upper ends of the first to third sub piston valves and the lower ends of the first to third main piston valves are coupled by the link mechanisms so as to communicate with each other, and the biasing members are disposed inside. The biasing members may be disposed only in the main piston valves or the sub piston valves or inside the both, depending on the structure of the brass instrument. As the biasing members, those originally disposed in the brass instrument may be used if possible, or biasing members different from the disposed ones may be used. The fourth piston valve includes the sliding resonance tube for lowering the pitch by 2.5 steps, but this sliding resonance tube is pulled out, and instead, the one end and the other end of the bypass tube are inserted and fixed. The fourth piston valve is originally intended to cause the communication via the sliding tube when operated, but is capable of causing the communication via the bypass tube when the bypass tube is inserted thereto as replacement. Owing to the communication via the bypass tube (indirect communication), it is possible to lower the pitch of a note of the piccolo trumpet by octave. Fingerwork is the same as that when the piccolo trumpet is singly played, except the operation of the fourth piston valve. "Sol (G)" of brass instruments including the piccolo trumpet is a note produced by using a harmonic of "do (C)". The piccolo trumpet including the valve mechanism of claim 9 is capable of lowering the pitch by one octave as described above, but in addition to the one octave lower note, it is also possible to produce harmonics of the lowered note. That is, if a note (pitch) of the main tube in the direct communication state is "do (high c)" which is a second harmonic, notes producible by the operation of the fourth piston valve are one octave lower "do (middle c)", 2.5 step lower "sol (middle g)", "do (high c)" at the same pitch, two step higher "mi (high e)", 3.5 step higher "sol (high g)", and the like. Here, the notations in the above parentheses represent tone names including the distinction of the pitches of the notes. Here, a conventional trumpet without the valve mechanism of claim 9 attached thereto will be studied. The conventional piccolo trumpet is capable of producing a "sol (middle g)" note by the operation of the fourth piston valve. It seems that, when the valve mechanism of claim 9 is attached to the conventional piccolo trumpet, the aforesaid function of the fourth piston valve is lost, and the "sol (middle g)" note cannot be produced. However, if one octave lower "do (middle c)" can be produced as described above, "sol (middle g) which is one of its harmonics can be produced, and therefore, the function of the fourth piston valve is not lost. That is, notes that can be produced by the conventional piccolo trumpet are covered, and in addition, notes one octave lower than these notes can also be produced. As far as the harmonics are used, the same fingering can be used irrespective of the presence/absence of the valve mechanism of claim 9. In this way, according to the valve mechanism of claim 9, it is possible to modify an existing brass instrument such as a piccolo trumpet to a musical instrument capable of producing one octave lower notes, with the existing function kept maintained. Further, since no special connection method is adopted, it is possible to easily detach the valve mechanism, which makes it possible to return the modified musical instrument back to the existing brass instrument. It should be noted that the aforesaid operation and effect are the same as for the valve mechanisms and the brass instruments of the other claims.

Feature of Invention of Claim 10

A valve mechanism for musical instrument according to an invention of claim 10 (hereinafter, referred to as "a valve mechanism of claim 10" when appropriate) is a valve mechanism attachable/detachable to/from a brass instrument (its typical examples include a piccolo trumpet) including: first to fourth piston valves provided with bottom screws and inserted in order from a mouthpiece side toward a bell side; and a sliding resonance tube included in the fourth piston valve. The valve mechanism of claim 10 includes: a bypass tube having one end and the other end; first to third sub piston valves inserted in serial communication in the middle of the bypass tube; and three link mechanisms disposed inside the first to third sub piston valves respectively. The one end and the other end of the bypass tube are fixedly insertable to the fourth piston valve in place of the detached sliding resonance tube, and the first to third sub piston valves are screw-fixable to the first to third piston valves in place of the detached bottom screws. The three link mechanisms couple piston upper ends of the first to third sub piston valves and piston lower ends of the first to third piston valves and biasing members are disposed inside the main valve casings and/or the sub valve casings to allow the first to third sub piston valves to be operated in linkage by the operation of the first to third piston valves. Here, the bypass tube is set to such a length that an acoustic length becomes about 2L when the fourth piston valve is operated to open a bypass route from the middle of the main tube and cause indirect communication of the main tube which is in direct communication before the operation of the fourth piston valve, where L is an acoustic length of the main tube.

According to the valve mechanism of claim 10, when it is attached to an existing brass instrument such as, for example, a piccolo trumpet, the brass instrument is capable of producing a one octave lower note. Here, a description will be given, taking a piccolo trumpet as an example. The piccolo trumpet includes the first to fourth piston valves, and the first to third piston valves include resonance tubes or tuning slides for lowering the pitch by one step, a half step, and 1.5 steps when necessary, and the fourth piston valve includes the tuning slide for lowering the pitch by 2.5 steps. Further, the piston valves include the bottom screws at bottom portions thereof. The bottom screws of the first to third piston valves are detached, and instead, the first to third sub piston valves are screw-fixed. The bottom screw of the fourth piston valve need not to be detached. Prior to the fixation, the upper ends of the first to third sub piston valves and the lower ends of the first to third main piston valves are coupled so as to communicate with each other by the link mechanisms, and the biasing members are disposed inside. The biasing members may be disposed only in the main piston valves or the sub piston valves or inside the both, depending on the structure of the brass instrument. As the biasing members, those originally disposed in the brass instrument may be used if possible, or biasing members different from the disposed ones may be used. The fourth piston valve includes the sliding resonance tube for lowering the pitch by 2.5 steps, but this sliding resonance tube is pulled out, and instead, the one end and the other end of the bypass tube are inserted and fixed. The fourth piston valve is originally intended to cause the communication via the tuning slide when operated, but is capable of causing the communication via the bypass tube when the bypass tube is inserted thereto as replacement. Owing to the communication via the bypass tube (indirect communication), it is possible to lower the pitch of a note of the piccolo trumpet by octave since the tube length which is L in the direct communication state becomes substantially 2L. Fingerwork is the same as that when the piccolo trumpet is singly played, except the operation of the fourth piston valve. "Sol (G)" of brass instruments including the piccolo trumpet is a note produced by using a harmonic of "do (C)" The piccolo trumpet including the valve mechanism of claim 10 is capable of lowering the pitch by one octave as described above, but in addition to the one octave lower note, it is also possible to produce harmonics of the lowered note. That is, if a note (pitch) of the main tube in the direct communication state is "do (high c)" which is a second harmonic, notes producible by the operation of the fourth piston valve are one octave lower "do (middle c)", 2.5 step lower "sol (middle g)", "do (high c)" at the same pitch, two step higher "mi (high e)", 3.5 step higher "sol (high g)", and the like. Here, the notations in the above parentheses represent tone names including the distinction of the pitches of the notes. Here, a conventional trumpet without the valve mechanism of claim 10 attached thereto will be studied. The conventional piccolo trumpet is capable of producing a "sol (middle g)" note by the operation of the fourth piston valve. It seems that, when the valve mechanism of claim 10 is attached to the conventional piccolo trumpet, the aforesaid function of the fourth piston valve is lost and the "sol (middle g)" note cannot be produced. However, if one octave lower "do (middle c)" can be produced as described above, "sol (middle g) which is one of its harmonics can be produced, and therefore, the function of the fourth piston valve is not lost. That is, notes that can be produced by the conventional piccolo trumpet are covered, and in addition, notes one octave lower than these notes can also be produced. As far as the harmonics are used, the same fingering can be used irrespective of the presence/absence of the valve mechanism of claim 10. In this way, according to the valve mechanism of claim 10, it is possible to modify an existing brass instrument such as a piccolo trumpet to a musical instrument capable of producing one octave lower notes, with the existing function kept maintained. Further, since no special connection method is adopted, it is possible to easily detach the valve mechanism, which makes it possible to return the modified musical instrument back to the existing brass instrument. It should be noted that the aforesaid operation effect are the same as for the valve mechanisms and the brass instruments of the other claims.

Feature of Invention of Claim 11

A brass instrument according to an invention of claim 11 (hereinafter, referred to as "a brass instrument of claim 11" when appropriate) has the valve mechanism of claim 9 or 10. A trumpet and a horn are typical examples of the brass instrument.

According to the brass instrument of claim 11, musical performance exhibiting the operation and effect of the valve mechanism of claim 9 or 10 is enabled, that is, it is possible to produce one octave lower notes by the operation of the changeover valve.

Feature of the Invention of Claim 12

In a brass instrument according to an invention of claim 12 (hereinafter, referred to as "a brass instrument of claim 12" when appropriate), a trumpet is the brass instrument on the premise of the brass instrument of claim 11.

According to the brass instrument of claim 12, the operation and effect of the valve mechanism of claim 11 can be realized in the trumpet. This does not intend to limit the brass instrument to the trumpet, but since trumpets adopting piston valves or rotary valves are in wide use, the application of the present invention to such trumpets contributes to more widespread use.

Effect of the Invention

According to the present invention, in melodies of a played musical composition, it is possible to use relatively low-order harmonics even in a high register with the tonality left as it is, while making scale adjustment by instantaneously selecting an ideal tube length. Therefore, there is an advantage of enabling remarkable improvement in a degree of freedom and reliability of musical performance in a wide register with almost no change in fingering and weight of a conventional brass instrument.

EXPLANATION OF REFERENCE SYMBOLS

Figure 1:
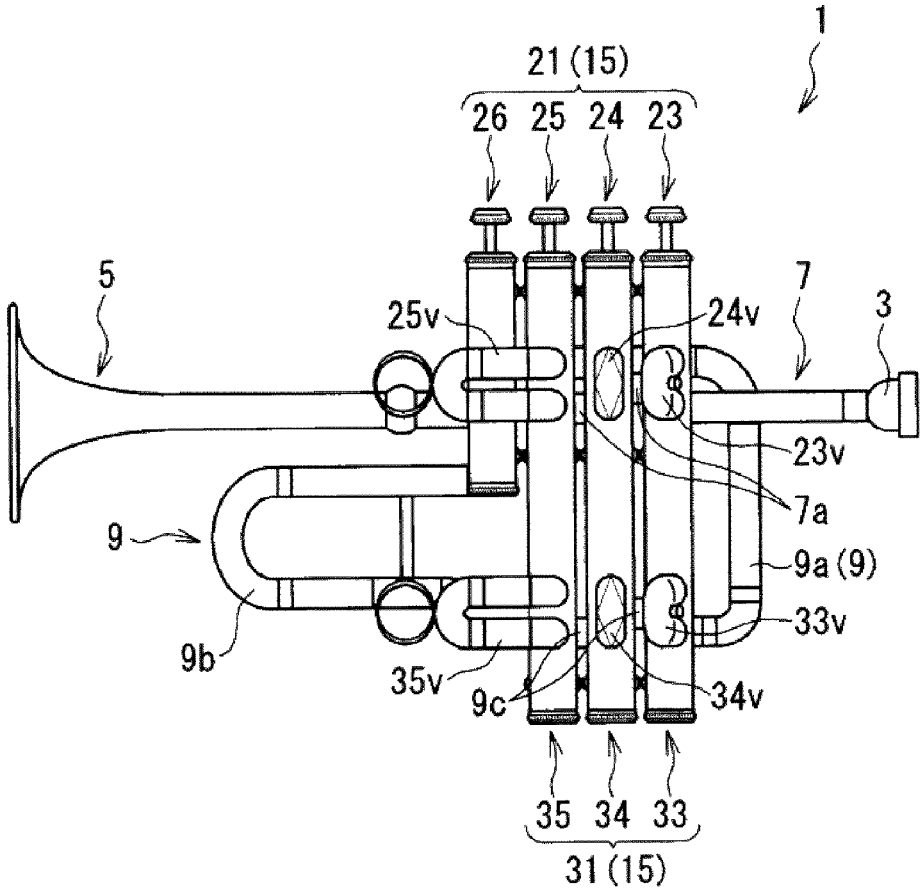
FIG. 1 is a front view of a piccolo trumpet according to this embodiment.

1 brass instrument (trumpet, piccolo trumpet)
3 mouthpiece
5 bell
7 main tube
9 bypass tube
15 valve mechanism
21 main valve
23 first main valve
23' first layered rotary valve
24 second main valve
24' second layered rotary valve
25 third main valve
25' third layered rotary valve
26 fourth main valve (fourth valve, changeover valve)
26' fourth rotary valve (fourth valve, changeover valve)
23*v*, 24*v*, 25*v*, 26*v* U-shaped resonance tube
31 sub valve mechanism
33 first sub valve
34 second sub valve
35 third sub valve
33*v*, 34*v*, 35*v*, 36*v* U-shaped resonance tube
41 link mechanism
45 coil spring (biasing member)

BEST MODE FOR CARRYING OUT THE INVENTION

Figure 2:
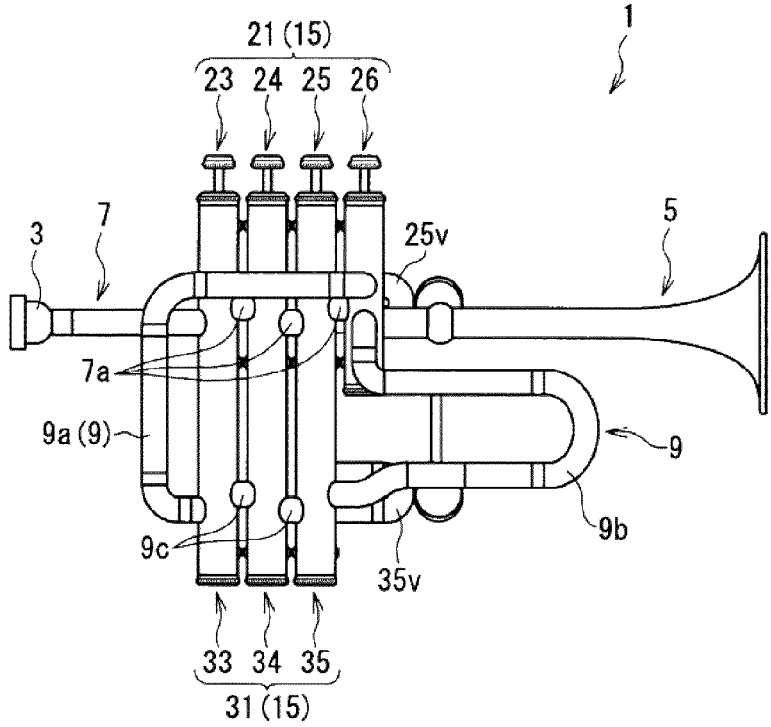
FIG. 2 is a rear view of the piccolo trumpet according to this embodiment.
Figure 3:
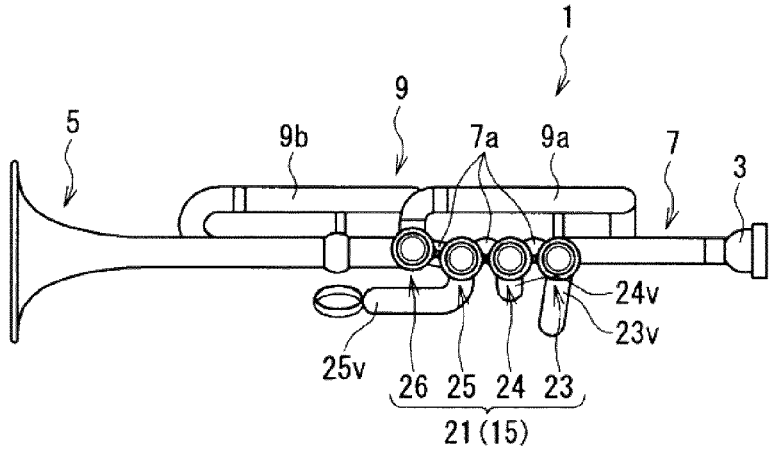
FIG. 3 is a plan view of the piccolo trumpet according to this embodiment
Figure 4A:
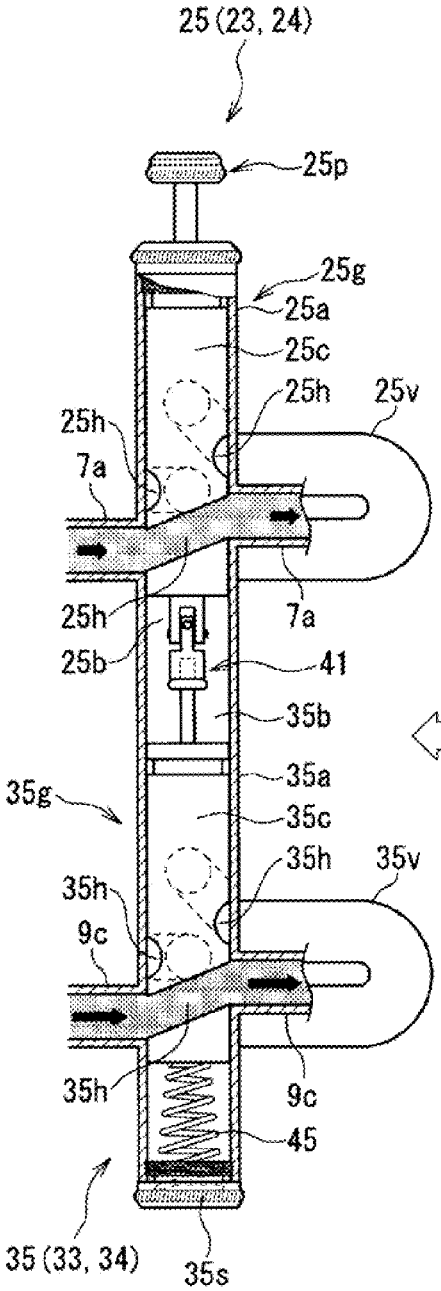
FIG. 4 are vertical sectional views of valve casing tubing of a third valve.
Figure 4B:
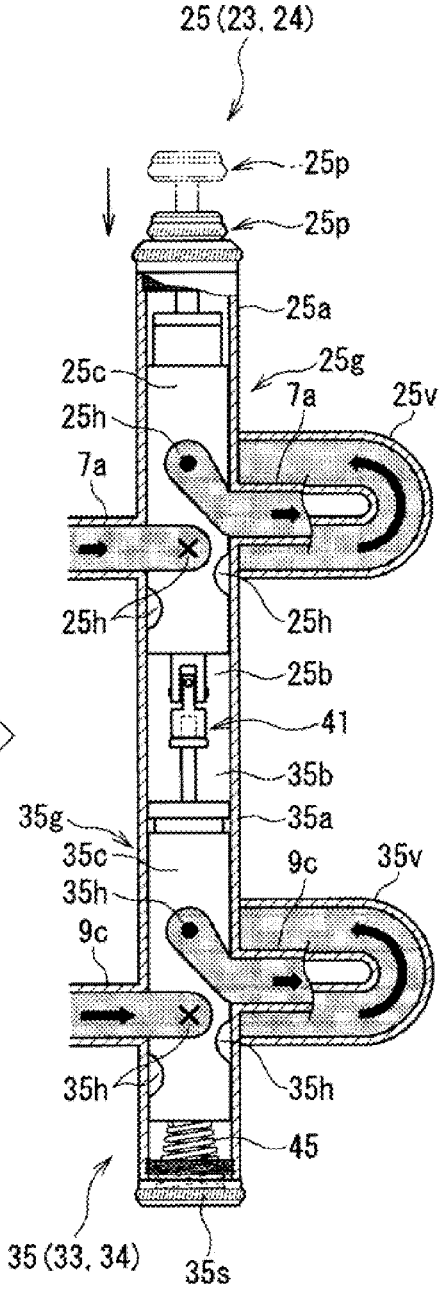
Figure 5A:
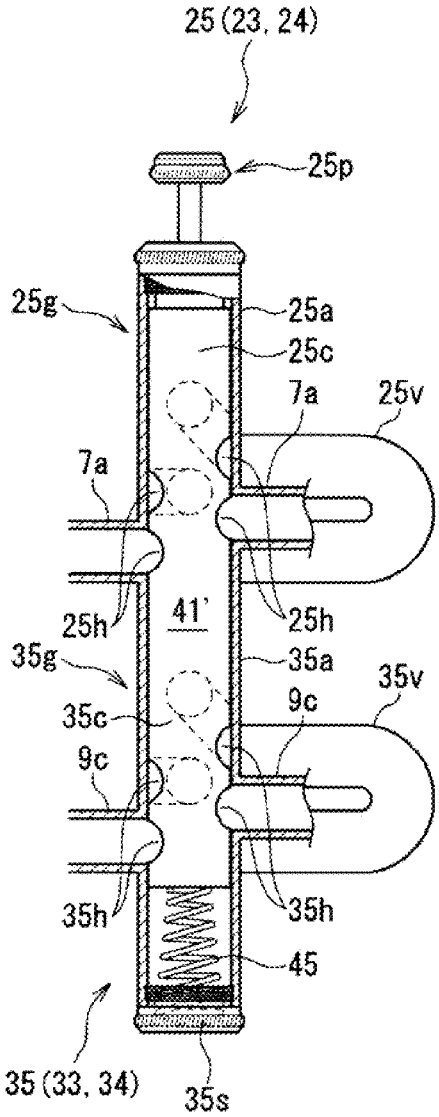
FIG. 5 are vertical sectional views showing a modification example of the third valve shown in FIG. 4.
Figure 5B:
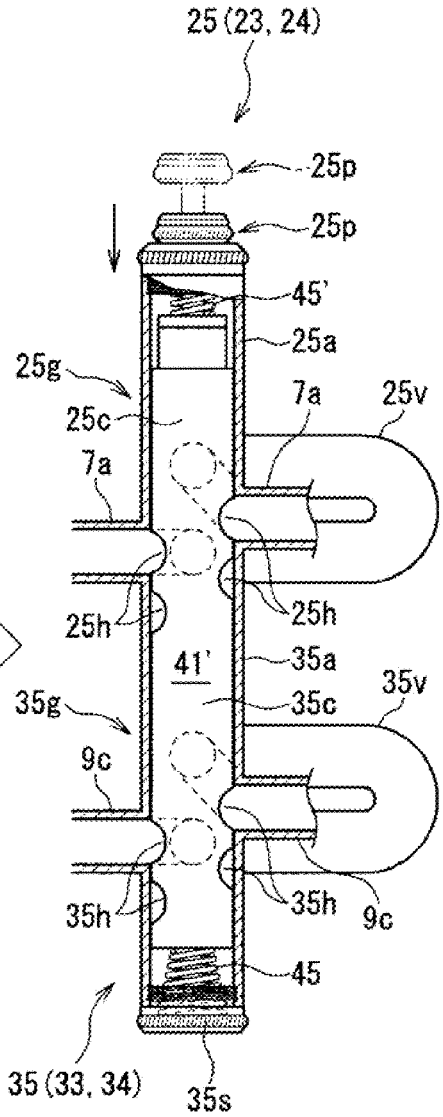
Figure 6:
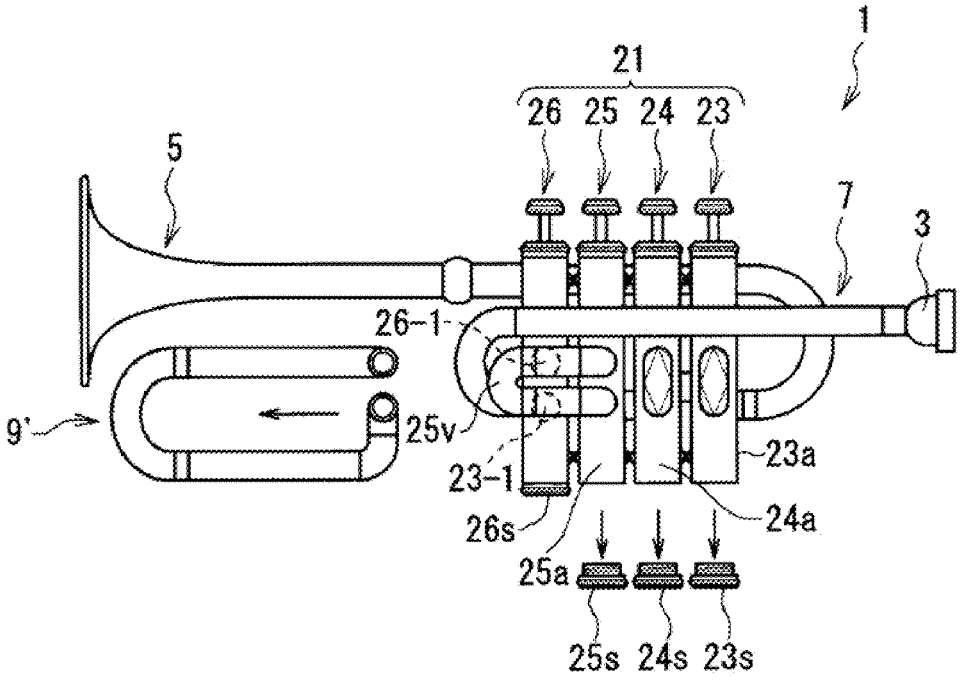
FIG. 6 is a front view of an existing piccolo trumpet.
Figure 7:
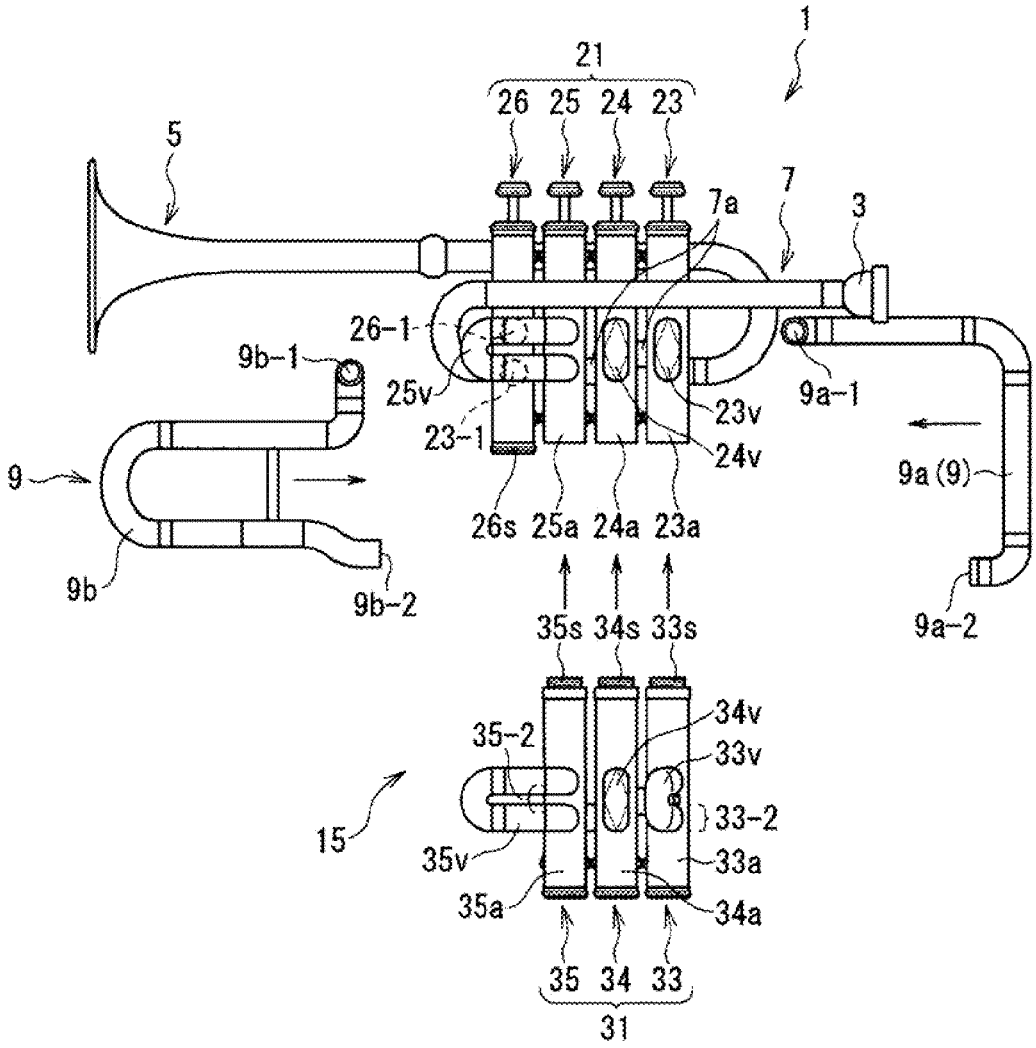
FIG. 7 is a front view showing how a valve mechanism is attached to the existing piccolo trumpet.
Figure 18:
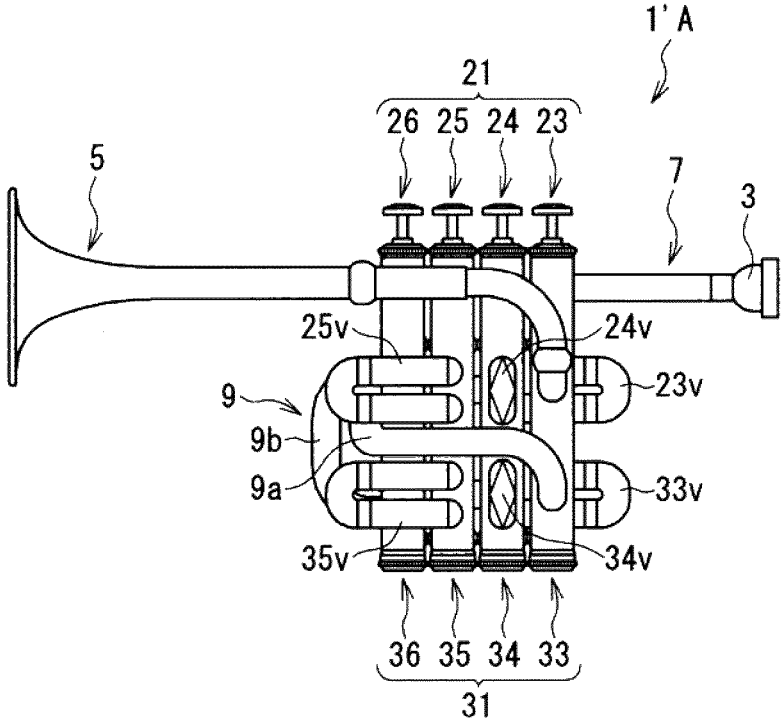
FIG. 18 is a view showing the operation of the piccolo trumpet.
Figure 19:
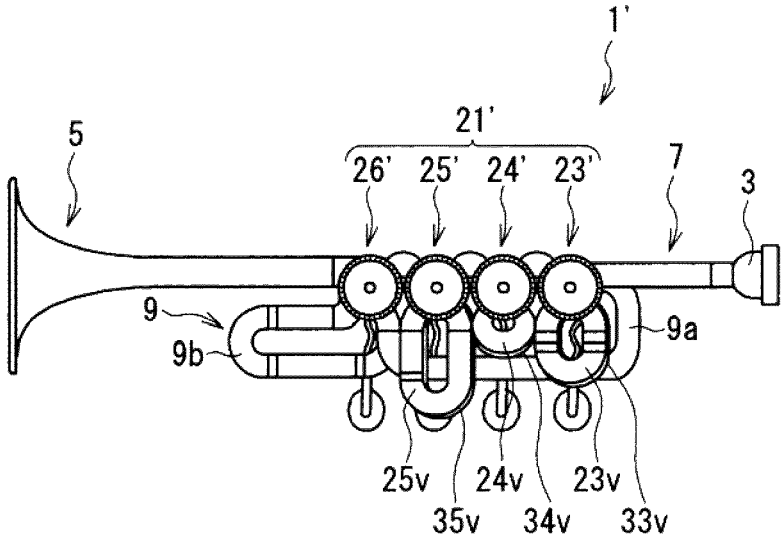
FIG. 19 is a view showing the operation of the piccolo trumpet.
Figure 20:
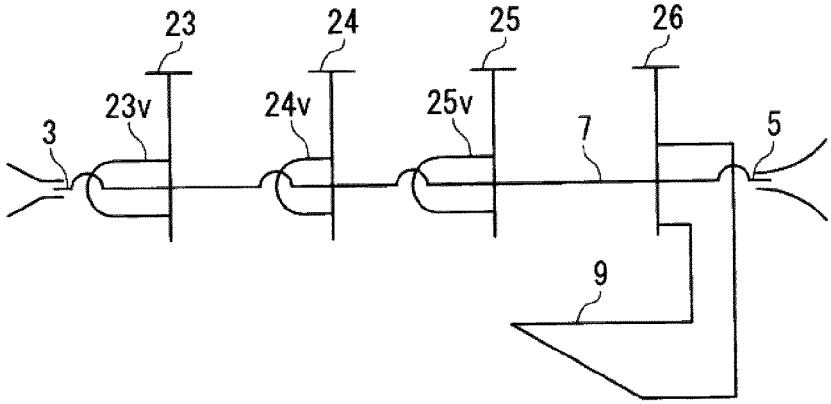
FIG. 20 is a tubing view showing a conventional art.
Figure 21:
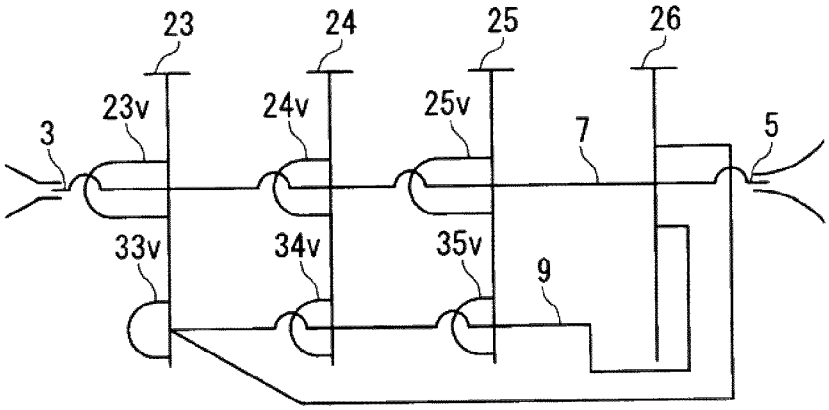
FIG. 21 is a tubing view showing a conventional art.
Figure 22:
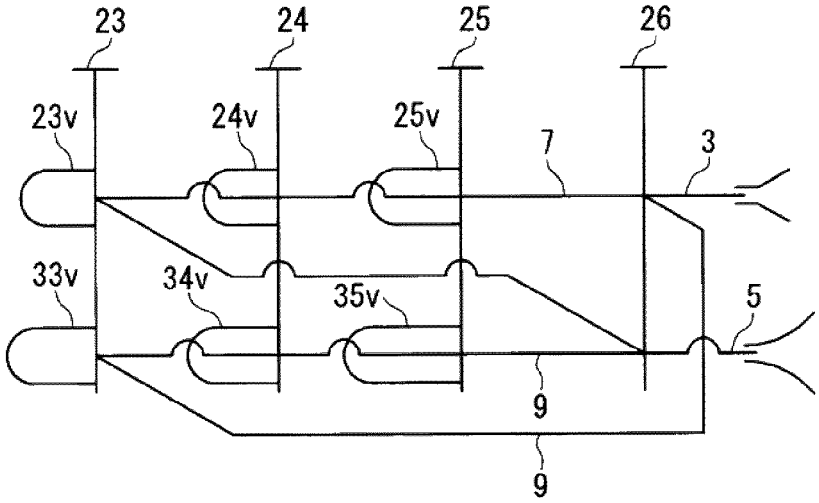
FIG. 22 is a tubing view showing a conventional art.
Figure 23:
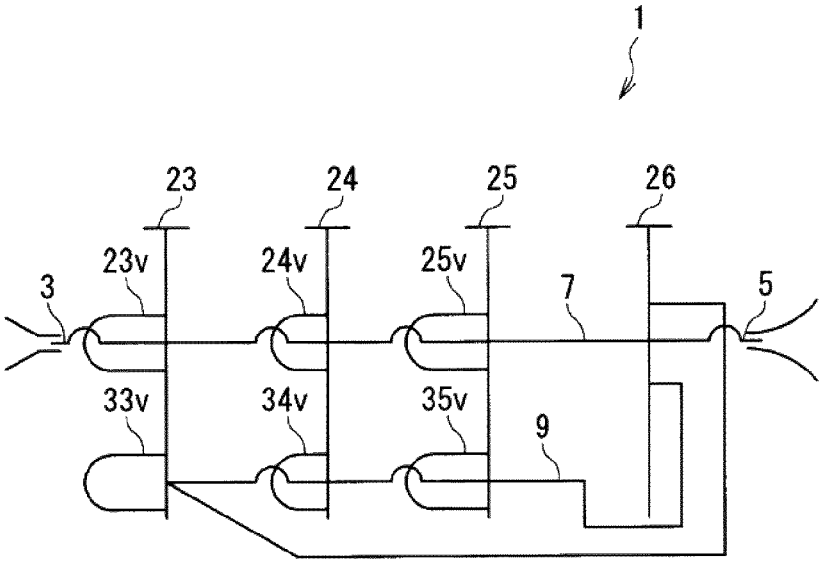
FIG. 23 is tubing of a brass instrument according to this embodiment.

A best mode for carrying out the present invention (hereinafter, referred to as "this embodiment" when appropriate) will be described with reference to the drawings. FIG. 1 is a front view of a piccolo trumpet according to this embodiment, FIG. 2 is a rear view of the same, and FIG. 3 is a plan view of the same. FIG. 4 are vertical sectional views of valve casing tubing of a third valve. FIG. 5 are vertical sectional views showing a modification example of the third valve shown in FIG. 4. FIG. 6 is a front view of an existing piccolo trumpet. FIG. 7 is a front view showing how a valve mechanism is attached to the existing piccolo trumpet. FIGS. 8 to 19 are views showing the operation of the piccolo trumpet. FIGS. 20 to 22 are tubing views showing conventional arts. FIG. 23 is tubing of a brass instrument according to this embodiment.

(Valve Mechanism and Brass Instrument)

A valve mechanism for musical instrument according to this embodiment (hereinafter, simply referred to as "a valve mechanism") and a brass instrument provided with the valve mechanism will be described based on FIGS. 1 to 5. In this embodiment, a piccolo trumpet (hereinafter, referred to as "a trumpet" when appropriate) as a typical example of a brass instrument will be taken up in the description. Further, "a piston valve" is simply called "a valve" in this specification unless otherwise mentioned.

(Rough Structure of Trumpet)

As shown in FIGS. 1 to 5, a trumpet 1 includes a valve mechanism 15 inserted between a mouthpiece 3 and a bell 5. The valve mechanism 15 includes: a main tube 7 through which the mouthpiece 3 and the bell 5 directly communicate with each other; a fourth valve 26 (changeover valve 26) inserted in the middle of the main tube 7; a bypass tube 9 which takes a bypass route from the middle of the main tube 7, and when the fourth changeover valve is operated, causes indirect communication of the main tube 7 which is in direct communication before the operation of the fourth changeover valve; a main valve group 21 composed of main valves inserted in serial communication in the middle of the main tube 7 on a mouthpiece 3 side (may be on a bell 5 side) of the fourth valve; a sub valve group 31 composed of the same number of sub valves as the number of the main valves of the main valve group 21, inserted in the middle of the bypass tube 9; and a link mechanism group 41 composed of the same number of link mechanisms as the number of the main valves of the main valve group 21 (the sub valves of the sub valve group 31). The main valves (a first main valve 23, a second main valve 24, and a third main valve 25) composing the main valve group 21, the sub valves (a first sub valve 33, a second sub valve 34, and a third sub valve 35) composing the sub valve group 31, and link mechanisms 41 . . . (see FIGS. 4 and 5) composing the link mechanism group correspond to one another. As shown in FIGS. 1 and 2, the bypass tube 9 includes an L-shaped first bypass partial tube 9*a* through which the fourth main valve 26 and the first sub valve 33 communicate with each other, a U-shaped second bypass partial tube 9*b* through which the third sub valve 35 and the fourth main valve 26 communicate with each other, and branch tubes 9*c*, 9*c* through which the sub valves communicate with one another. Here, when one or two or more of the first main valve 23, the second main valve 24, and the third main valve 25 is operated, the corresponding sub valve (the first sub valve 33, the second sub valve 34, the third sub valve 35) is operable in linkage via the link mechanism 41 (disposed in the main valve) which corresponds to the operated main valve. Further, the bypass tube 9 is set to such a length that a note one octave lower than a note produced only by the main tube 7 can be produced (such a length that the total length of the main tube 7 and the bypass tube 9 via the fourth valve 26 owing to the indirect communication becomes about 2L, where L is an acoustic length of the main tube 7) in the indirect communication state. Each of the link mechanisms 41 in this embodiment is formed by a universal joint (adjustable joint).

(Structure of Valve Mechanism)

Subsequently, FIGS. 1 to 5 will be referred to. The first main valve 23, the second main valve 24, and the third main valve 25 composing the main valve group 21 have substantially the same structure, and therefore, the description here will focus on the third main valve 25. The third main valve 25 includes: a main valve casing 25*g* having a columnar hollow portion 25*b* surrounded by a sidewall 25*a*; a main piston 25*c* provided with a piston hole 25*h* and sealed inside the main valve casing 25*g* to be slidable in a longitudinal direction; and a main U-shaped resonance tube 25*v* which is provided outside the main valve casing 25*g* and whose both ends communicate with the columnar hollow portion 25*b*. The main U-shaped resonance tube 25*v* is set to such a length that the pitch is lowered by 1.5 steps by the operation. What makes the third main valve 25 structurally different from the first main valve 23 and the second main valve 24 is only the length of the main U-shaped resonance tube. A main U-shaped resonance tube 23*v* of the first main valve 23 is set to such a length that the pitch is lowered by 1 step, and a main U-shaped resonance tube 24*v* of the second main valve 24 is set to such a length that the pitch is lowered by a half step.

The first sub valve 33, the second sub valve 34, and the third sub valve 35 composing the sub valve group 31 have substantially the same structure, and therefore, the description here will focus on the third sub valve 35 corresponding to the third main valve 25. The third sub valve 35 includes: a sub valve casing 35*g* having a columnar hollow portion 35*b* (communicating with the columnar hollow portion 25*b*) surrounded by a sidewall 35*a* integrally formed with the sidewall 25*a* of the third main valve 25; a sub piston 35*c* provided with a piston hole 35*h* and sealed in the sub valve casing 35*g* to be slidable in the longitudinal direction; a sub U-shaped resonance tube 35*v* which is provided outside the sub valve casing 35*g* and whose both ends communicate with the columnar hollow portion 35*b*; and a coil spring (biasing member) 45 disposed in a bottom portion of the sub valve casing 35*g*. The sub U-shaped resonance tube 35*v* is set to such a length that the pitch is lowered by 1.5 steps when it is operated in linkage by the operation of the main valve 25. What makes the third sub valve 35 structurally different from the first sub valve 33 and the second sub valve 34 is only the length of the sub U-shaped resonance tube. A sub U-shaped resonance tube 33*v* of the first sub valve 33 is set to such a length that the pitch is lowered by one step, and a sub U-shaped resonance tube 34*v* of the second sub valve 34 is set to such a length that the pitch is lowered by a half step. The acoustic length of each of the sub U-shaped resonance tubes is set substantially equal to the acoustic length of each of the corresponding main U-shaped resonance tubes. That is, the main U-shaped resonance tube 23*v* and the sub U-shaped resonance tube 33*v*, the main U-shaped resonance tube 24*v* and the sub U-shaped resonance tube 34*v*, and the main U-shaped resonance tube 25*v* and the sub U-shaped resonance tube 35*v* are set equal in length (acoustically equal in length), respectively. The aforesaid main and sub U-shaped resonance tubes communicate with each other when the corresponding main and sub valves are operated, and are closed when the operation is cancelled. Note that the main U-shaped resonance tube 25*v* (the sub U-shaped resonance tube 35*v*) provided in the third main valve 25 (the third sub valve 35) is formed by a tuning slide. This is intended to make the length adjustable to enable the pitch correction. From the same reason, the main and sub U-shaped resonance tubes other than the aforesaid ones may be formed by tuning slides.

Each of the link mechanisms 41 has a function of transmitting the operation of the first main valve 23 (the second main valve 24, the third main valve 25) to the corresponding first sub valve 33 (the second sub valve 34, the third sub valve 35) to operate it in linkage, and each of the coil springs 45 has a function of resiliently returning the main piston 23*c* (the main piston 24*c*, the main piston 25*c*) pressed down by the operation and the sub piston 33*c* (the sub piston 34*c*, the sub piston 35*c*) which is pressed down in linkage, into the original positions (the positions before the operation). Incidentally, the coil springs 45 in this embodiment are disposed inside the sub valve casings 33, 34, 35, but may additionally be disposed inside the main valve casings 23, 24, 25 or alternatively, may be disposed only inside the main valve casings 23, 24, 25. The first main valve 23 (the first sub valve 33) and the second main valve 24 (the second sub valve 34), the second main valve 24 (the second sub valve 34) and the third main valve 25 (the third sub valve 35), and the third main valve 25 (the third sub valve 35) and the fourth main valve (changeover valve) 26 are communicatably coupled by branch tubes 7*a*, . . . constituting part of the main tube 7 (9*a*, . . . constituting part of the bypass tube 9). The subject of the present invention is the method of how the valve mechanism 15 and the U-shaped resonance tubes are combined for coupling, and therefore the operation of the valves will not be described. Incidentally, a third main valve 25 (a third sub valve 35) shown in FIG. 5 is a modification example of the third main valve 25 (the third sub valve 35) shown in FIG. 4, and only differences therebetween lie in that the main piston 25*c* and the sub piston 35*c* which are separate structures in the latter are integrated in the former and a coil spring (a biasing member) 45' is also disposed inside the main valve casing 25*a* in the latter. Reference symbol 41' in FIG. 5 is a link mechanism corresponding to the link mechanism 41 in FIG. 4. The other points are common to the both, and therefore, the reference symbols used in FIG. 4 are used to designate the common members in FIG. 5.

(Structure of Trumpet)

One form of manufacturing the trumpet will be described with reference to FIGS. 6 and 7. The trumpet 1 according to this embodiment includes the aforesaid components, and can be manufactured by combining these components. Alternatively, it can be also manufactured by modifying an existing trumpet. A trumpet suitable for the modification is a piccolo trumpet. This is because the piccolo trumpet includes a fourth valve as well as a first to a third valve, and the fourth valve is usable for switching between the direct communication of the main tube and the indirect communication thereof via a bypass tube. Therefore, if an existing piccolo trumpet is at hand, by purchasing and obtaining a valve mechanism to be described next and attaching the obtained valve mechanism to the existing piccolo trumpet, it is possible to modify the existing piccolo trumpet to a piccolo trumpet capable of producing not only existing notes but also notes one-octave lower than the existing notes. A concrete description will be given in different paragraphs.

In FIGS. 6 and 7, it is premised that there exists a brass instrument, that is, a piccolo trumpet as a typical example, including: a first to a fourth valve (which become main valves 1 to 4 after the modification) 23, 24, 25, 26 provided with bottom screws 23*s*, 24*s*, 25*s*, 26*s* and inserted in order from a mouthpiece 3 side toward a bell 5 side; and a sliding resonance tube 9' provided at least in the fourth valve 26. The valve mechanism 15 is attached/detached to/from the piccolo trumpet 1. The valve mechanism 15 includes: the bypass tube 9 having one end 9*a*-1 and the other end 9*b*-1; the first to third sub valve 33, 34, 35 inserted in serial communication in the middle of the bypass tube 9; and the three link mechanisms (not shown in FIG. 7, see FIG. 4) disposed inside the first to third sub valves 33, 34, 35. The one end 9*a*-1 and the other end 9*b*-1 of the bypass tube are fixedly insertable in insertion ports 26-1, 23-1 of the fourth valve 26 in place of the detached sliding resonance tube (U-shaped resonance tube 25*v*). To insert the first to third sub valves 33, 34, 35 to the middle of the bypass tube 9, the other end 9*a*-2 of the first bypass partial tube 9*a* having the one end 9*a*-1 at its end is inserted and fixed to an insertion port 33-2 of the first sub valve 33, and the other end 9*b*-2 of the second bypass partial tube 9*b* having the other end 9*b*-1 at its end is inserted and fixed to an insertion port 35-2 of the third sub valve 35.

Here, the three bottom screws 23*s*, 24*s*, 25*s* are detached, and the lower ends of the pistons (not shown in FIGS. 6 and 7, see FIG. 4) disposed inside the main valve casings 23*a*, 24*a*, 25*a* and the upper ends of the pistons (not shown in FIGS. 6 and 7, see FIG. 4) disposed inside the sub valve casings 33*a*, 34*a*, 35*a* are coupled by the link mechanisms (not shown in FIGS. 6 and 7, see FIG. 4). On upper ends of the sub valve casings 33*a*, 34*a*, 35*a*, there are formed screws which can be screw-fixed by engaging with screw traces from which the bottom screws 23*s*, 24*s*, 25*s* of the main valve casings 23*a*, 24*a*, 25*a* have been detached, and this screw fixing enables the integration of the both. On bottom portions of the sub valve casings 33*a*, 34*a*, 35*a*, the biasing members (not shown in FIGS. 6 and 7, see FIG. 4) are disposed. A biasing member may be provided at one place or two places or more other than the bottom portion. By the above structure, when the first to third valves 23, 24, 25 are operated, the first to third sub valves 33, 34, 35 can be operated in linkage. Further, it goes without saying that the bypass tube 9 is set to such a length that a note one octave lower than a note produced only by the main tube 7 can be produced when the fourth valve 26 is operated to open the bypass route from the middle of the main tube 7 and bring the main tube 7, which is in the direct communication before the operation, into the indirection communication. By thus attaching the valve mechanism 15 according to the present invention to the existing piccolo trumpet, it is possible to produce not only basic notes of the piccolo trumpet but also notes one octave lower than the basic notes. As described above, according to this embodiment, it is possible to realize the object of improving a degree of freedom and reliability of scale adjustment in an arbitrary register or as wide a register as possible with the minimum number of components and without impairing fingering practicality or easiness in holding a musical instrument. This will be described in more detail in different paragraphs.

Figure 8:
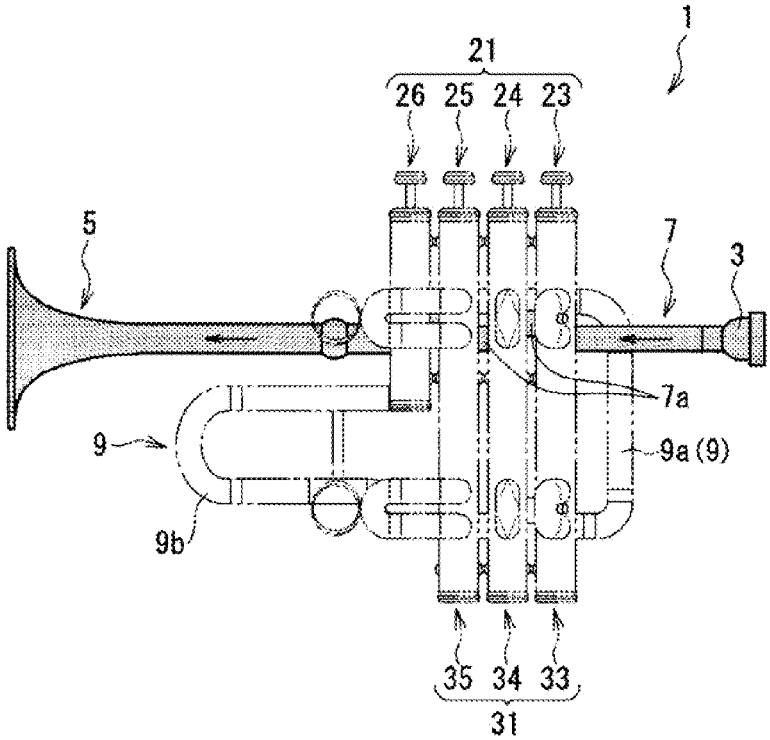
FIG. 8 is a view showing the operation of the piccolo trumpet.
Figure 9:
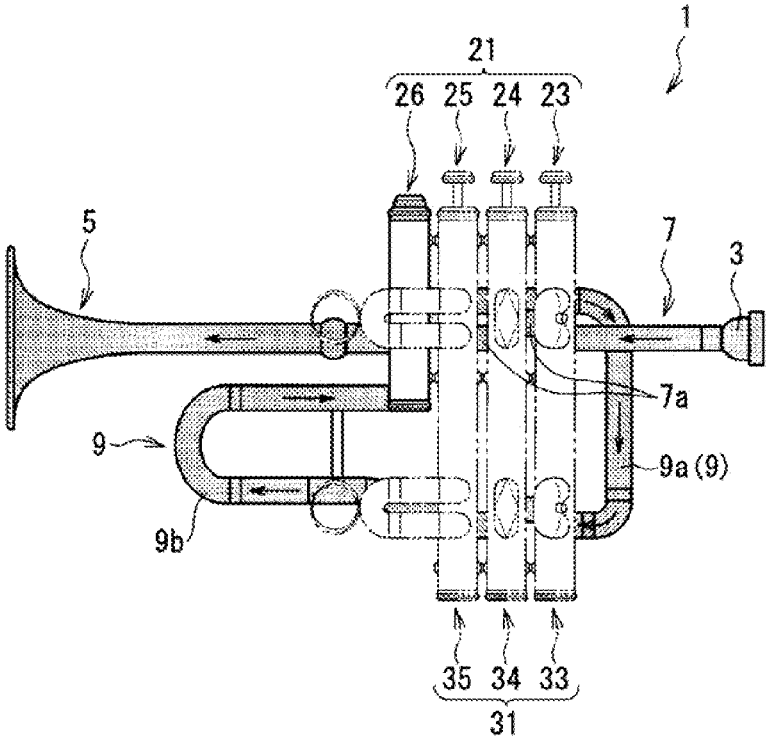
FIG. 9 is a view showing the operation of the piccolo trumpet.
Figure 10:
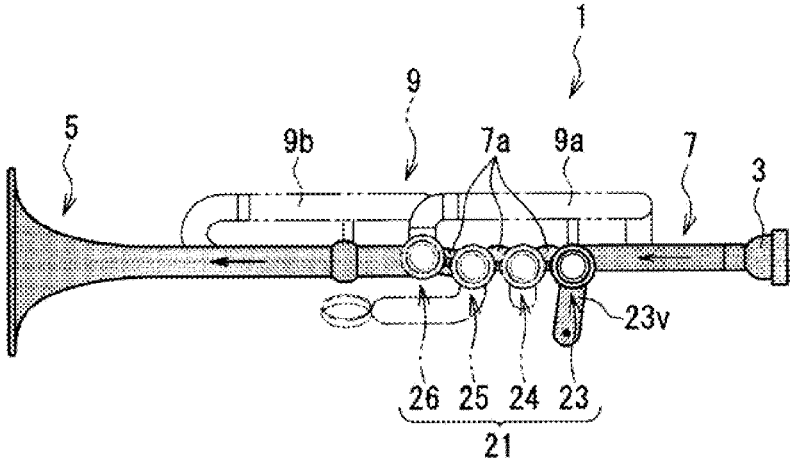
FIG. 10 is a view showing the operation of the piccolo trumpet.
Figure 11:
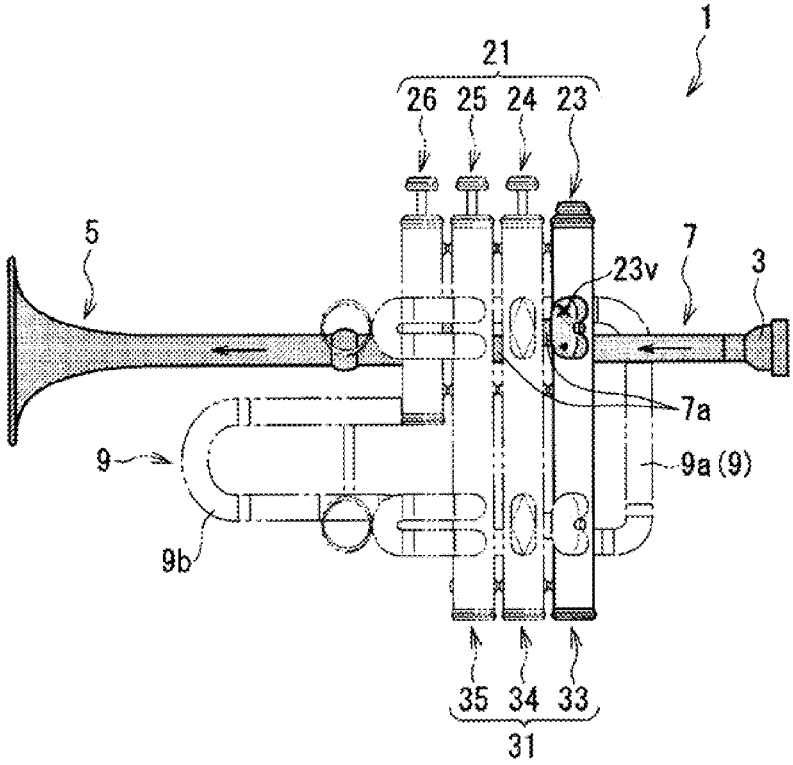
FIG. 11 is a view showing the operation of the piccolo trumpet.
Figure 12:
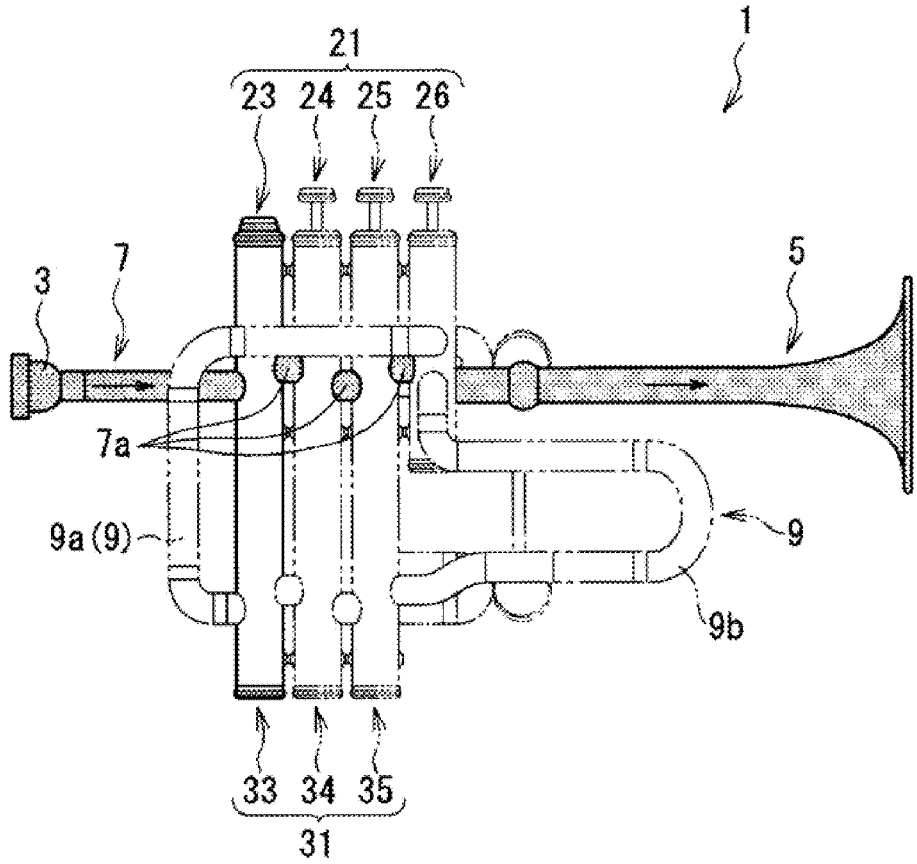
FIG. 12 is a view showing the operation of the piccolo trumpet.
Figure 13:
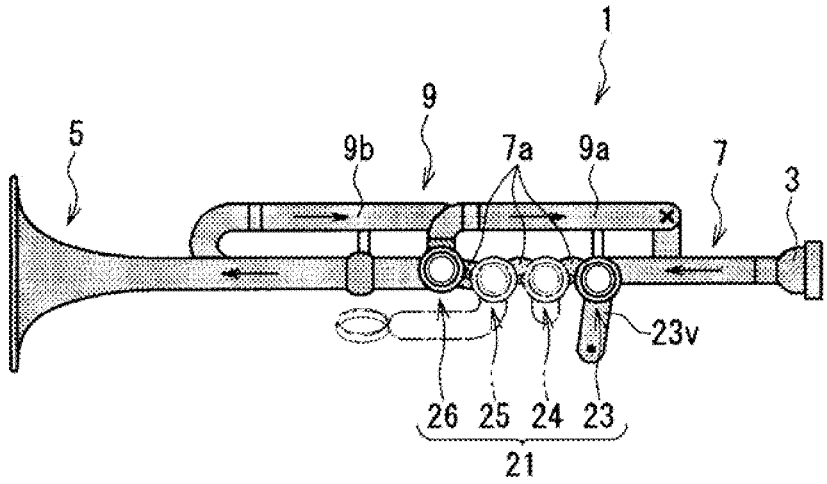
FIG. 13 is a view showing the operation of the piccolo trumpet.
Figure 14:
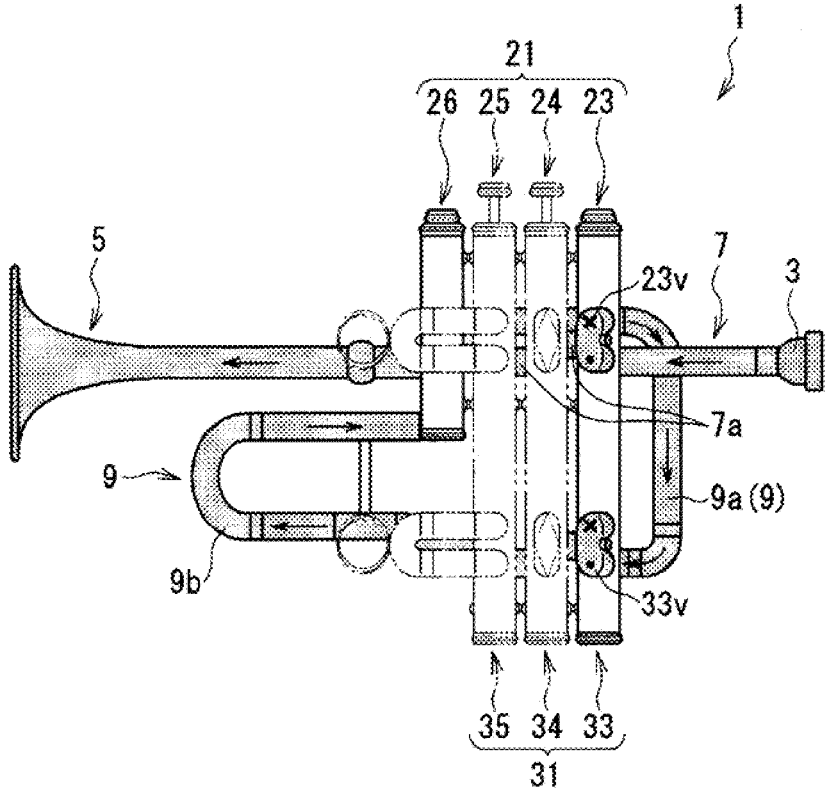
FIG. 14 is a view showing the operation of the piccolo trumpet.
Figure 15:
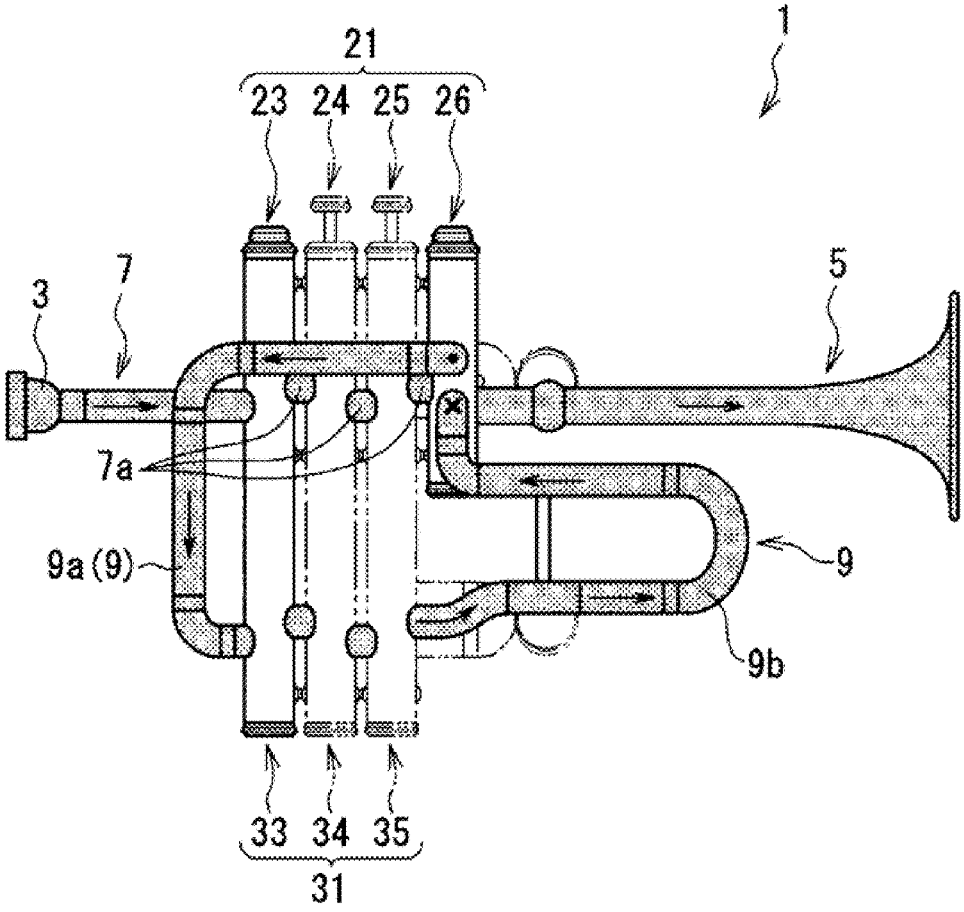
FIG. 15 is a view showing the operation of the piccolo trumpet.
Figure 16:
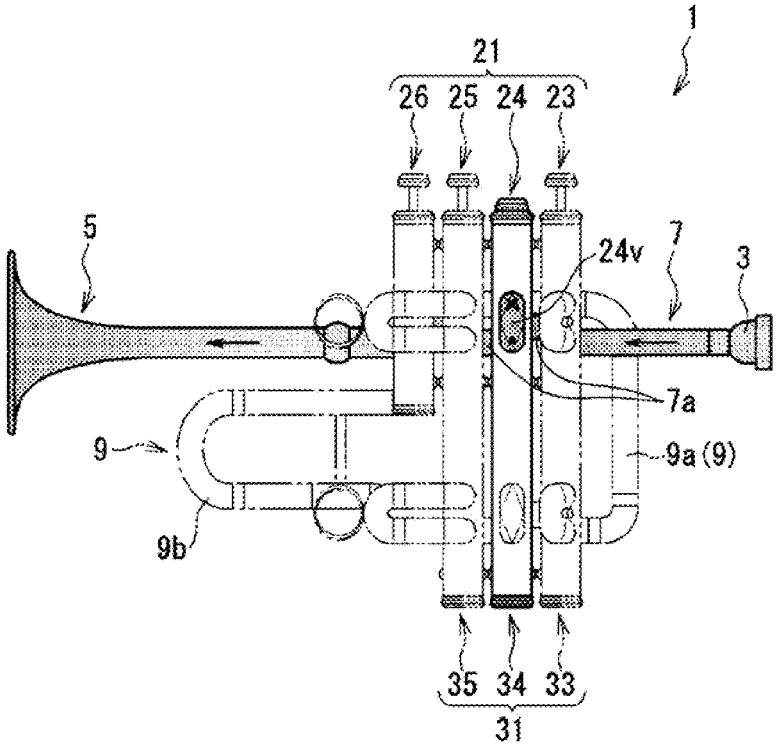
FIG. 16 is a view showing the operation of the piccolo trumpet.
Figure 17:
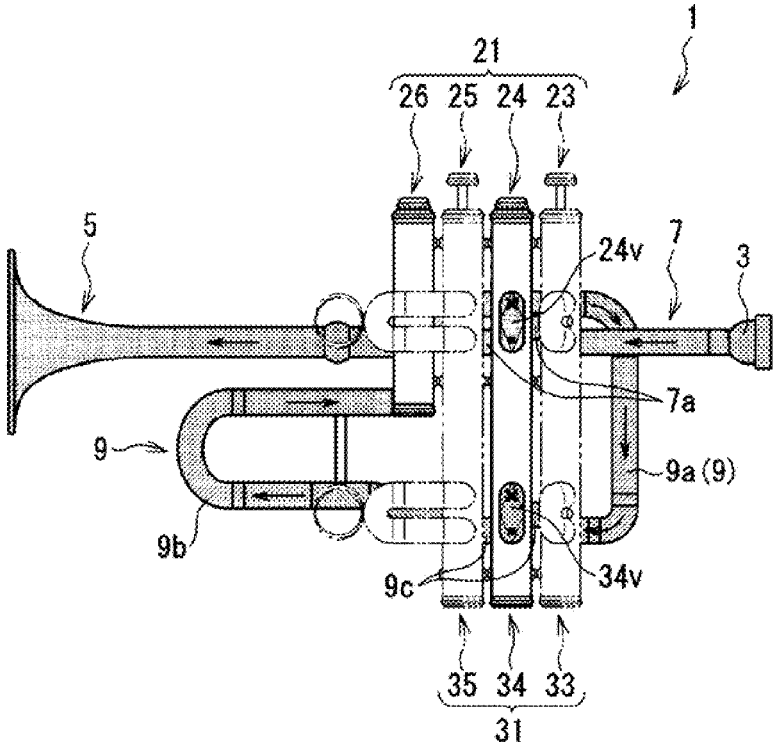
FIG. 17 is a view showing the operation of the piccolo trumpet.

Specifically, the original purpose of the fourth vale 26 of the piccolo trumpet 1 is to cause the communication via the tuning slide 9' (see FIG. 6) when it is operated, but causes the communication via the bypass tube 9 when the bypass tube 9 is attached thereto as replacement. By the communication via the bypass tube 9 (indirect communication), the tube length which is L in the direct communication state becomes substantially 2L and thus a note of the piccolo trumpet 1 can be lowered by octave. The piccolo trumpet 1 shown in FIG. 8 is in a state where none of the valves is operated (a state of the direct communication of the main tube 7). Dark-colored parts are parts communicating with each other, and the arrows show a direction in which breadth passes (the same applies hereinafter). FIG. 9 shows a state where only the fourth valve 26 is operated. The state of the indirect communication via the bypass route 9 is shown. Fingerwork is the same as that when the piccolo trumpet is singly played, except the operation of the fourth valve 26. "Sol (G)" of the piccolo trumpet 1 is a note produced by the use of a harmonic of "do (C)". The piccolo trumpet 1 provided with the valve mechanism 15 is capable of lowering the pitch by one octave as previously described, and is also capable of producing harmonics of the lowered note in addition to the one octave lower note itself. That is, if a note (pitch) of the main tube in the direct communication state is "do (high c) which is a second harmonic (see FIG. 8), notes producible by the operation of the fourth piston valve are one octave lower "do (middle c), 2.5 step lower "sol (middle g), "do (high c)" at the same pitch, two step higher "mi (high e), 3.5 step higher "sol (high g), and so on (see FIG. 9). The conventional piccolo trumpet 1 (see FIG. 6) without the valve mechanism 15 attached thereto is capable of producing a "sol (middle g)" note by the operation of the fourth valve 26. When the valve mechanism 15 is attached to the conventional piccolo trumpet 1, it seems that the function of the fourth valve 26 is lost and the "sol (middle g)" note cannot be produced, but if one octave lower "do (middle c)" can be produced as described above, "sol (middle g)" which is one of its harmonics can be produced, and therefore the function of the fourth valve 26 is not lost. That is, notes producible by the conventional piccolo trumpet 1 are covered and in addition, notes one octave lower than these notes can be produced. As far as the harmonics are used, the same fingering is usable irrespective of the presence/absence of the valve mechanism 15. By the way, as shown in FIGS. 10 to 12, when only the first main valve 23 (the first sub valve 33) is operated, "fa (F)" and its harmonics can be produced, and when the fourth valve 23 in FIGS. 13 to 15 is operated with the first main valve 23 (the first sub valve 33), notes one octave lower than these notes and harmonics thereof can be produced. As shown in FIG. 16, when only the second main valve 24 (the second sub valve 34) is operated, "ti (B)" and its harmonics can be produced, and when the fourth valve 23 is operated with the second main valve 24 (see FIG. 17), notes one octave lower than these notes and their harmonics can be produced. The same can be said as for fingering other than the above.

First Modification Example of This Embodiment

A first modification example of this embodiment will be described with reference to FIG. 18. What makes a trumpet 1A according to the first modification example different from the trumpet 1 according to FIGS. 1 and 2 is the arrangement order of members, and therefore the reference symbols used in FIG. 18 are the same as the reference symbols used in FIGS. 1 and 2. A mouthpiece 3 of the trumpet 1A communicates with a fourth main valve 26, and the fourth main valve 26 communicates with a third main valve 25, a second main valve 24, and a first main valve in this order, and a bell 5 communicates with the first main valve 23. A bypass tube 9 includes a first bypass partial tube 9*b* through which a third sub valve 35 and the fourth main valve 26 communicate with each other, and a second bypass partial tube 9*a* through which the fourth main valve 26 and a first sub valve 33 communicate with each other.

When the first main valve 23 to which a U-shaped resonance tube 23*v* and a U-shaped resonance tube 33*v* equal in length are coupled is operated, a main tube 7 is extended by a length corresponding to a whole step, and when the second main valve 24 to which a U-shaped resonance tube 24*v* and a U-shaped resonance tube 34*v* equal in length are coupled is operated, the main tube 7 is extended by a length corresponding to a half step, and when the third main valve 25 to which a U-shaped resonance tube 25*v* and a U-shaped resonance tube 35*v* equal in length are coupled is operated, the main tube 7 is extended by a length corresponding to 1.5 steps. In this manner, when the first to third main valves 23 to 25 are operated, the U-shaped resonance tubes 33*v*, 34*v*, 35*v* communicate with the bypass tube 9, and when the main tube 7 is made to communicate with the bypass tube 9 (indirect communication) by the operation of the fourth main valve 26, the length of the main tube 7 and the U-shaped resonance tubes 23*v*, 24*v*, 25*v* becomes substantially doubled. Further, it is similarly possible to realize a reverse method of shutting the bypass tube 9 from the main tube 7 by the operation of the fourth main valve 26.

It has been acoustically known that pitches of harmonics of a brass instrument are generally lowered by one octave when the length of its tube is doubled. Therefore, if an original pitch of a short main tube is do (high c) which is a second harmonic, pitches producible by the operation of the valve 4 are one octave lower do (middle c), 2.5 step lower sol (middle g), do (high c) at the same pitch, two step higher mi (high e), 3.5 step higher sol (high g), and so on. Here, the notations in the parentheses represent tone names including the distinction of the pitches of the notes.

Since such a mounting form of the valve device and the resonance tubes is adopted, as for the pitch correction when the plural valves are simultaneously operated, only the downward pitch correction by lips while the musical instrument is played is practically sufficient as is done in a conventional brass instrument, and it is possible to surely produce notes in a relatively low-order harmonic range with almost no change in fingering and weight of the musical instrument. Further, a player can always select two kinds of musical instruments different in register by one octave, by operating the fourth valve 4, which facilitates changing the musical instruments during the musical performance and creating an ad-lib effect. Further, it is possible to produce high-order harmonics even when the player changes to a long main tube and to compare these notes with or instantaneously replace these notes by notes in the same register produced by a short main tube, which provides an effect of increasing the kind of producible tones.

Second Modification Example of This Embodiment

A second modification example of this embodiment will be described based on FIG. 19. What makes a piccolo trumpet 1' different from the previously described piccolo trumpet 1 is that a valve mechanism 21' of the piccolo trumpet 1' is mainly formed by two-layered rotary valves, while the valve mechanism 15 of the piccolo trumpet 1 is mainly formed by the two-layered piston valves. Hereinafter, this is mainly described. Reference symbol 23' denotes a first layered rotary valve, reference symbol 24' denotes a second layered rotary valve, reference symbol 25' denotes a third layered rotary valve, and reference symbol 26' denotes a fourth rotary valve. The fourth rotary valve 26' is a single valve. The other members are the same as the members shown in FIGS. 1 and 2, and therefore, in FIG. 19, the same members are only denoted by the same reference symbols as those shown in FIGS. 1 and 2, and description of these members will be omitted. The rotary valves refer to valve devices having rotors rotating in a circumferential direction in columnar hollow portions of the first to fourth rotary valves 23', 24', 25', 26', but since the subject of the present invention is the method of how the valves and the U-shaped resonance tubes are combined for coupling, description of the inside of the rotary valve devices will be omitted.

When the first rotary valve 23' to which a U-shaped resonance tube 23*v* and a U-shaped resonance tube 33*v* equal in length are coupled is operated, a main tube 7 is extended by a length corresponding to a whole step, and when the second rotary valve 24' to which a U-shaped resonance tube 24*v* and a U-shaped resonance tube 34*v* equal in length are coupled is operated, the main tube 7 is extended by a length corresponding to a half step, and when the third rotary valve 25' to which a U-shaped resonance tube 25*v* and a U-shaped resonance tube 35*v* equal in length are coupled is operated, the main tube 7 is extended by a length corresponding to 1.5 steps. In this manner, when the first to third rotary valves 23', 24', 25', 26' are operated, the U-shaped resonance tubes 33*v*, 34*v*, 35*v* communicate with the bypass tube 9, and when the main tube 7 is made to communicate with the bypass tube 9 by the operation of the fourth rotary valve 26', an acoustic length of the main tube 7 and the U-shaped resonance tubes 33*v*, 34*v*, 35*v* becomes substantially doubled. Further, it is similarly possible to realize a reverse method of shutting the bypass tube 9 from the main tube 7 by the operation of the fourth rotary valve 26'.

INDUSTRIAL AVAILABILITY

Since the valve device which allows easy selection of tubing without changing tonality by coupling the resonance tubes equal in length and the bypass tube and which is capable of instantaneously changing the length of the main tube is attached, the valve device is suitable for a brass instrument which needs to be capable of adjusting the scale by relatively low-order harmonics in a wide register and for which it is indispensable to make almost no change in fingering and weight.

What is claimed is:

1. A valve mechanism for musical instrument inserted between a mouthpiece and a bell, the valve mechanism comprising:

a main tube through which the mouthpiece and the bell directly communicate with each other;

a changeover valve inserted in the middle of said main tube;

a bypass tube which takes a bypass route from the middle of said main tube and, when said changeover valve is operated, causes indirect communication of said main tube which is in direct communication before the operation of said changeover valve;

a main valve group composed of main valves inserted in serial communication in the middle of said main tube on a mouthpiece side or a bell side of said changeover valve;

a sub valve group composed of the same number of sub valves as the number of the main valves of said main valve group, inserted in serial communication in the middle of said bypass tube; and a link mechanism group composed of the same number of link mechanisms as the number of the main valves of said main valve group, wherein:

the main valves composing said main valve group, the sub valves composing said sub valve group, and the link mechanisms composing said link mechanism group correspond to one another;

by operating each of the main valves, the corresponding sub valve is operable in linkage via the corresponding link mechanism; and said bypass tube is set to such a length that a note one octave lower than a note produced only by said main tube is producible when said main tube is brought into the indirect communication.

2. A valve mechanism for musical instrument inserted between a mouthpiece and a bell, comprising a main tube through which the mouthpiece and the bell directly communicate with each other;

a changeover valve inserted in the middle of said main tube;

a bypass tube which takes a bypass route from the middle of said main tube and when said changeover valve is operated, causes indirect communication of said main tube which is in direct communication before the operation of said changeover valve;

a main valve group composed of main valves inserted in serial communication in the middle of said main tube on a mouthpiece side or a bell side of said changeover valve;

a sub valve group composed of the same number of sub valves as the number of the main valves of said main valve group, inserted in serial communication in the middle of said bypass tube; and a link mechanism group composed of the same number of link mechanisms as the number of the main valves of said main valve group, wherein:

the main valves composing said main valve group, the sub valves composing said sub valve group, and the link mechanisms composing said link mechanism group correspond to one another;

by operating each of the main valves, the corresponding sub valve is operable in linkage via the corresponding link mechanism; and said bypass tube is set to such a length that an acoustic length becomes about 2L due to the indirect communication via said bypass tube, where L is an acoustic length of said main tube.

3. The valve mechanism for musical instrument according to claim 1 or 2, wherein the main valves and the sub valves have substantially the same acoustic structure.

4. The valve mechanism for musical instrument according to claim 3, wherein:

the main valves include main valve casings each having a columnar hollow portion surrounded by a sidewall, main pistons provided with piston holes and sealed inside the respective main valve casings to be slidable in a longitudinal direction, and main U-shaped resonance tubes with different lengths which are provided outside the main valve casings and whose both ends communicate with the columnar hollow portions;

the sub valves include sub valve casings each having a columnar hollow portion surrounded by a sidewall, sub pistons provided with piston holes and sealed inside the sub valve casings to be slidable in the longitudinal direction, and sub U-shaped resonance tubes with different lengths which are provided outside the sub valve casings and whose both ends communicate with the columnar hollow portions, the valve mechanism further comprising biasing members disposed inside one or both of the main valve casings and the sub valve casings, and wherein acoustic lengths of the sub U-shaped resonance tubes are set substantially equal to acoustic lengths of the corresponding main U-shaped resonance tubes.

5. The valve mechanism for musical instrument according to claim 1 or 2, wherein at least one of the main U-shaped resonance tubes and at least one of the sub U-shaped resonance tubes are tuning slides.

6. The valve mechanism for musical instrument according to claim 1 or 2, wherein the main valves and the sub valves are rotary valves.

7. A brass instrument comprising the valve mechanism according to claim 1 or 2.

8. The brass instrument according to claim 7, wherein the brass instrument is a trumpet.

9. A valve mechanism for musical instrument attachable to or detachable from a brass instrument including: first to fourth piston valves provided with bottom screws and inserted in order from a mouthpiece side toward a bell side; and a sliding resonance tube included in the fourth piston valve, the valve mechanism comprising:

a bypass tube having one end and the other end;

first to third sub piston valves inserted in serial communication in the middle of said bypass tube; and three link mechanisms disposed inside said first to third sub piston valves respectively, wherein:

the one end and the other end of said bypass tube are fixedly insertable to the fourth piston valve in place of the detached sliding resonance tube;

said first to third sub piston valves are screw-fixable to the first to third piston valves in place of the detached bottom screws;

said three link mechanisms couple piston upper ends of said first to third sub piston valves and piston lower ends of the first to third piston valves and biasing members are disposed inside one or both of the main valve casings and the sub valve casings to allow said first to third sub piston valves to be operated in linkage by the operation of the first to third piston valves; and said bypass tube is set to such a length that a note one octave lower than a note produced only by the main tube is producible when the fourth piston valve is operated to open a bypass route from the middle of the main tube and bring the main tube, which is in direct communication before the operation of the fourth piston valve, into indirect communication.

10. A valve mechanism for musical instrument attachable to or detachable from a brass instrument including: first to fourth piston valves provided with bottom screws and inserted in order from a mouthpiece side toward a bell side; and a sliding resonance tube included in the fourth piston valve, the valve mechanism comprising:

a bypass tube having one end and the other end;

first to third sub piston valves inserted in serial communication in the middle of said bypass tube; and three link mechanisms disposed inside said first to third sub piston valves respectively, wherein:

the one end and the other end of said bypass tube are fixedly insertable to the fourth piston valve in place of the detached sliding resonance tube;

said first to third sub piston valves are screw-fixable to the first to third piston valves in place of the detached bottom screws;

said three link mechanisms couple piston upper ends of said first to third sub piston valves and piston lower ends of the first to third piston valves and biasing members are disposed inside one or both of the main valve casings and the sub valve casings to allow said first to third sub piston valves to be operated in linkage by the operation of the first to third piston valves; and said bypass tube is set to such a length that an acoustic length becomes about 2L when the fourth piston valve is operated to open a bypass route from the middle of the main tube and cause indirect communication of the main tube which is in direct communication before the operation of the fourth piston valve, where L is an acoustic length of the main tube.

11. A brass instrument comprising the valve mechanism according to claim 9 or 10.

12. The brass instrument according to claim 11, wherein the brass instrument is a trumpet.

* * * * *